US010017002B2

(12) United States Patent
James, Jr. et al.

(10) Patent No.: US 10,017,002 B2
(45) Date of Patent: Jul. 10, 2018

(54) REINFORCED POCKET DEVICE

(71) Applicants: Bobby G. James, Jr., Miamisbug, OH (US); Edward P. Busam, Mason, OH (US); Peter M. Bartlett, Bellbrook, OH (US)

(72) Inventors: Bobby G. James, Jr., Miamisbug, OH (US); Edward P. Busam, Mason, OH (US); Peter M. Bartlett, Bellbrook, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 541 days.

(21) Appl. No.: 13/898,525

(22) Filed: May 21, 2013

(65) Prior Publication Data

US 2013/0306715 A1 Nov. 21, 2013

Related U.S. Application Data

(60) Provisional application No. 61/649,619, filed on May 21, 2012.

(51) Int. Cl.
*B42D 3/00* (2006.01)
*B42D 7/00* (2006.01)
(Continued)

(52) U.S. Cl.
CPC ..... *B42F 3/003* (2013.01); *B42D 1/004* (2013.01); *B42D 1/005* (2013.01); *B42D 1/007* (2013.01);
(Continued)

(58) Field of Classification Search
CPC . B42D 1/00; B42D 19/00; B42D 5/00; B42D 3/00; B42D 7/00; B42D 1/005;
(Continued)

(56) References Cited

U.S. PATENT DOCUMENTS 2,062,436 A 12/1936 Yawman
2,523,724 A * 9/1950 Satz ..... B42F 7/06 281/31
(Continued)

FOREIGN PATENT DOCUMENTS

CA 2474403 1/2006
EP 0107519 11/1990
(Continued)

OTHER PUBLICATIONS

"Color Life Plus Expanding Slash Jackets," by Wilson Jones, ACCO 2012 Product Fact Book, p. 118.
(Continued)

*Primary Examiner* — Justin V Lewis
(74) *Attorney, Agent, or Firm* — Thompson Hine LLP

(57) ABSTRACT

A pocket device including a first major panel and a second major panel coupled together along a major fold line. The pocket device includes a first pocket panel coupled to the first major panel and defining a first pocket with the first major panel, the first pocket panel having an edge positioned adjacent to a mouth of the first pocket. The pocket device further includes a second pocket panel coupled to the second major panel and defining a second pocket with the second major panel, the second pocket panel having an edge positioned adjacent to a mouth of the second pocket. The pocket device has a first reinforcing material positioned on the first pocket panel adjacent to the mouth of the first pocket, wherein the first reinforcing material is spaced apart from the edge of the first pocket panel. The pocket device further has a second reinforcing material positioned on the second pocket panel adjacent to the mouth of the second pocket, wherein the second reinforcing material is spaced apart from the edge of the second pocket panel.

48 Claims, 20 Drawing Sheets

(51) Int. Cl.

| | |
|---|---|
| ***B42D 1/00*** | (2006.01) |
| ***B42D 19/00*** | (2006.01) |
| ***B42D 5/00*** | (2006.01) |
| ***B42F 3/00*** | (2006.01) |
| ***B42F 13/40*** | (2006.01) |
| ***B65D 27/08*** | (2006.01) |
| ***B42F 7/06*** | (2006.01) |
| ***B42F 11/00*** | (2006.01) |
| ***B42F 3/04*** | (2006.01) |
| ***B42F 23/00*** | (2006.01) |
| ***B65D 27/02*** | (2006.01) |

(52) U.S. Cl.
CPC ..... *B42F 3/04* (2013.01); *B42F 7/06* (2013.01); *B42F 11/00* (2013.01); *B42F 23/00* (2013.01); *B65D 27/02* (2013.01); *B65D 27/08* (2013.01)

(58) Field of Classification Search
CPC ..... B42D 1/004; B42D 1/007; B42F 13/00; B42F 13/40; B42F 3/02; B42F 13/02; B42F 13/20; B42F 13/12; B42F 3/003; B42F 3/04; B42F 23/00; B42F 7/06; B42F 11/00; B65D 27/02; B65D 27/08
USPC ..... 281/2, 3.1, 9, 10, 15.1, 38, 45; 402/4, 402/20, 31, 70, 71, 73
See application file for complete search history.

(56) References Cited

U.S. PATENT DOCUMENTS

| | | | | |
|---|---|---|---|---|
| 4,354,890 | A | 10/1982 | Maffey | |
| 4,749,121 | A | 6/1988 | Barber et al. | |
| 4,910,066 | A | 3/1990 | Foisie | |
| 5,256,130 | A | 10/1993 | Kachel et al. | |
| 5,284,362 | A | 2/1994 | Kachel et al. | |
| 5,364,200 | A | 11/1994 | Russo et al. | |
| 5,417,509 | A | 5/1995 | Schwartz | |
| 5,660,514 | A | 8/1997 | Wilson | |
| 5,711,750 | A | 1/1998 | Christensen et al. | |
| 5,720,427 | A | 2/1998 | Kachel et al. | |
| 5,842,720 | A | 12/1998 | Ward | |
| 6,196,750 | B1 | 3/2001 | Hansen | |
| 6,666,610 | B1 * | 12/2003 | Moor | A45C 7/0068 402/79 |
| 6,739,785 | B2 * | 5/2004 | Moor | B42D 5/042 281/38 |
| 7,234,288 | B2 | 6/2007 | Lebedevski et al. | |
| 8,162,204 | B2 | 4/2012 | Makofsky | |
| 8,272,558 | B2 | 9/2012 | Groch | |
| 8,685,505 | B2 | 4/2014 | Garant | |
| 2002/0093186 | A1 * | 7/2002 | Bullock | B42F 7/02 281/29 |
| 2002/0197098 | A1 * | 12/2002 | Palmer | G11B 33/0422 402/79 |
| 2003/0168846 | A1 | 9/2003 | Lebedevski | |
| 2003/0210950 | A1 | 11/2003 | Tims et al. | |
| 2005/0086912 | A1 | 4/2005 | Lebedevski et al. | |
| 2005/0180810 | A1 * | 8/2005 | Wong | B42F 11/00 402/79 |
| 2008/0179875 | A1 | 7/2008 | Witter | |
| 2012/0201594 | A1 * | 8/2012 | Busam | G09F 23/10 402/4 |

FOREIGN PATENT DOCUMENTS

| | | |
|---|---|---|
| EP | 0988995 | 3/2000 |
| WO | 00/54988 | 9/2000 |

OTHER PUBLICATIONS

"Pocket Pages," by Wilson Jones, ACCO 2012 Product Fact Book, p. 114.
"Snapper™ Folder," by Wilson Jones, ACCO 2012 Product Fact Book, p. 107.
"View-Tab Dividers" by Wilson Jones (2012).
US, Applicant-Initiated Interview Summary: U.S. Appl. No. 14/448,413, filed Oct. 2, 2015.
U.S., Final Office Action; U.S. Appl. No. 14/448,413 (dated Sep. 1, 2015).
International Search Report and Written Opinion, PCT/US2013/041951 (dated Aug. 23, 2013).
U.S., Office Action; U.S. Appl. No. 14/448,413, (dated Feb. 26, 2016).
U.S., Office Action, U.S. Appl. No. 14/448,413 (dated Dec. 8, 2016).
U.S., Office Action, U.S. Appl. No. 14/448,413 (dated Sep. 2, 2016).
U.S., Office Action, U.S. Appl. No. 14/448,413 (dated Apr. 6, 2017).

* cited by examiner

REINFORCED POCKET DEVICE

This application claims priority to U.S. Provisional Application Ser. No. 61/649,619, entitled Reinforced Pocket Divider Or Folder, filed on May 21, 2012, the entire contents of which are incorporated by reference herein.

This application is directed to a pocket device, and more particularly, to a pocket device that is reinforced at selected locations to improve the durability of the pocket device.

BACKGROUND

Pocket devices, such as pocket dividers or folders or the like may be used to store various items such as loose papers, writing utensils, or the like. However, repeated use of such devices, such as by placing contents into and/or removing contents from such pockets, can apply undue stress and/or tearing at various locations.

SUMMARY

In one embodiment, the present invention is a pocket device that is reinforced at selected location(s) to improve the durability of the pocket device. More particularly, in one embodiment the present invention is a pocket device including a first major panel and a second major panel coupled together along a major fold line. The pocket device includes a first pocket panel coupled to the first major panel and defining a first pocket with the first major panel, the first pocket panel having an edge positioned adjacent to a mouth of the first pocket. The pocket device further includes a second pocket panel coupled to the second major panel and defining a second pocket with the second major panel, the second pocket panel having an edge positioned adjacent to a mouth of the second pocket. The pocket device has a first reinforcing material positioned on the first pocket panel adjacent to the mouth of the first pocket, wherein the first reinforcing material is spaced apart from the edge of the first pocket panel. The pocket device further has a second reinforcing material positioned on the second pocket panel adjacent to the mouth of the second pocket, wherein the second reinforcing material is spaced apart from the edge of the second pocket panel.

DETAILED DESCRIPTION

Figure 1:
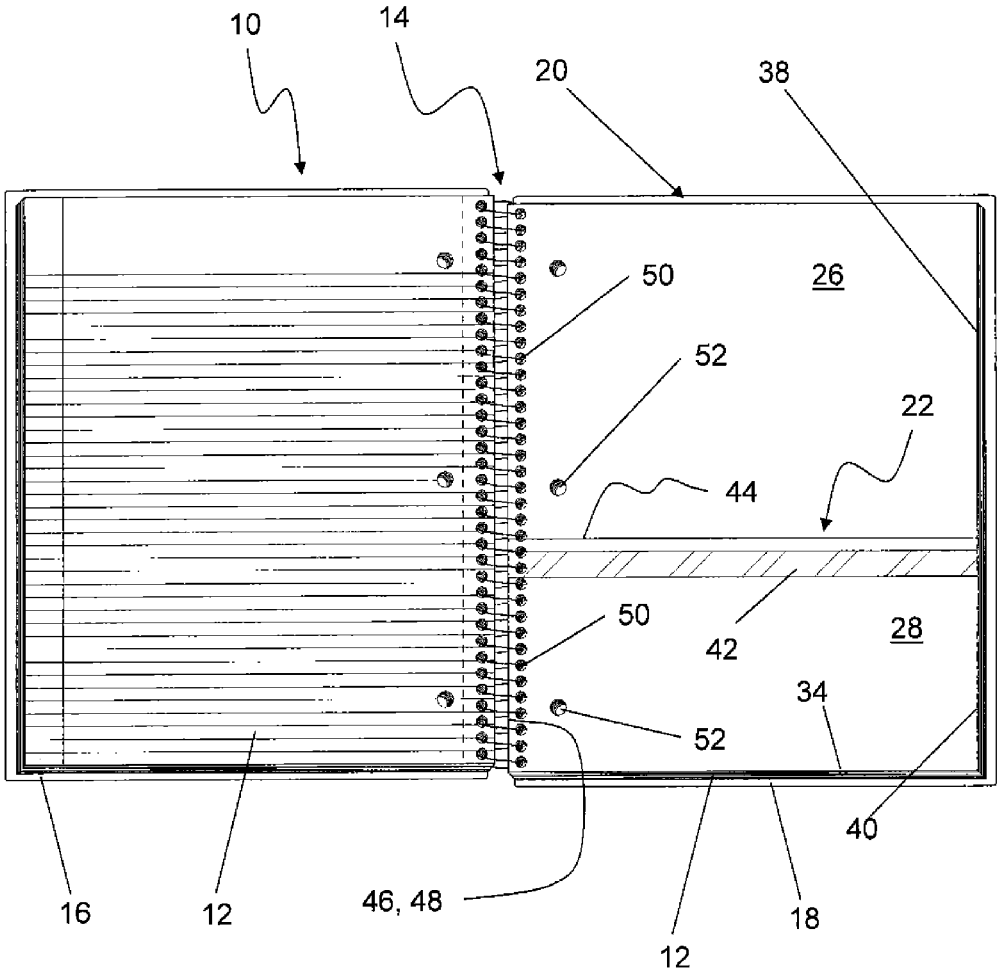
FIG. 1 is a top view of a notebook incorporating one embodiment of a pocket device.

As shown in FIG. 1, the pocket device disclosed herein can be part of, or used in conjunction with, a notebook, generally designated 10. In one embodiment the notebook 10 includes a set of papers 12 bound together by a binding mechanism 14, such as a coil binding mechanism, a spiral binding mechanism, twin-wire binding mechanism, adhesive bindings, sewn or stapled binding mechanism and the like. The papers 12 may be made of cellulose based or pulp based paper or the like that can easily be written upon by a variety of marking instruments, such as pens, pencils, markers, etc. The notebook 10 can include a front cover 16 and a back cover 18 that are bound to the papers 12 by the binding mechanism 14. The notebook 10 can further include one or more pocket devices 20 spaced throughout the thickness of the notebook 10/papers 12. Each pocket device 20 can operate as a divider to segregate various portions of the papers 12 for ease of access and use. Each pocket device 20 can include one or more pockets 22 configured to store loose items therein.

Figure 2:
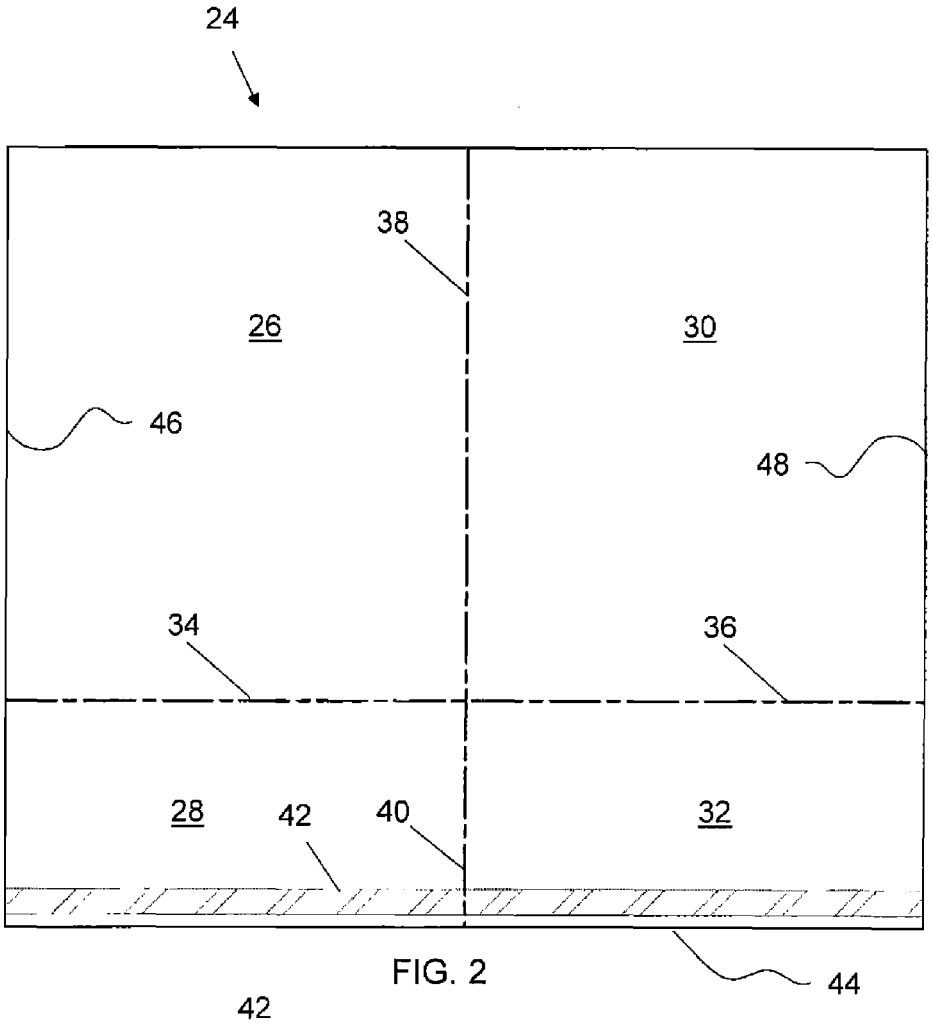
FIG. 2 is a top view of a blank that can be used to form the pocket device of FIG. 1, the blank having a reinforcing strip adjacent a lower edge thereof.

Each pocket device 20 can be made from a blank such as the blank 24 shown in FIG. 2. The blank 24 may be made of a relatively thin sheet-like material that is generally rectangular in shape, and includes a first or front major panel 26, a first or front pocket panel 28, a second or back major panel 30, and a second or back pocket panel 32. The blank 24 includes a horizontally extending front or first pocket fold line 34 that separates the front major panel 26 from the front pocket panel 28. Blank 24 also includes a horizontally extending back or second pocket fold line 36 that separates the back major panel 30 from the back pocket panel 32.

The blank 24 further includes a first or major panel vertical fold line 38 extending between and separating the front major panel 26 and back major panel 30. Finally, blank 24 includes a second or minor or pocket panel vertical fold line 40 extending between and separating the front pocket panel 28 and back pocket panel 32. The horizontal fold lines 34, 36 are collinear in the blank 24 and may be considered a single fold line; however once the pocket device 20 is formed the fold lines 34, 36 may appear more distinct. Similarly the vertical fold lines 38, 40 are collinear in the blank 24 and may be considered a single fold line but may become more distinct when the pocket device 20 is formed.

The blank 24/pocket device 20 (i.e. including major panels 26, 30 and pocket panels 28, 32 and other flaps, etc.) can be made of any of a wide variety of materials, including but not limited to plastic (such as polypropylene or vinyl), cardboard, cellulose-based materials, paperboard, plastic encased cardboard, etc. It should be noted that the fold lines 34, 36, 38, 40 (as well as other fold lines disclosed herein) can be formed as creases or areas of weakness in the blank 24. However, the fold lines 34, 36, 38, 40 need not necessarily be physically present in the blank 24, and can merely be imaginary lines about which the blank 24 is later folded.

The blank 24 of FIG. 2 includes a reinforcing strip or reinforcing material 42 positioned at or adjacent to, and extending generally parallel to, a lower edge 44 of the blank 24. The reinforcing area or strip 42 may be placed near but spaced away from the lower edge 44 as shown, or may be abutted against the lower edge 44 with no gap therebetween. In the illustrated embodiment, wherein the reinforcing strip 42 is spaced away from the lower edge 44, the spacing helps to account for manufacturing tolerances and avoids the strip 42 or parts thereof from overhanging the adjacent edge 44. This spacing arrangement can be particularly useful since, as will be described in greater detail below, the pocket panels 28, 32 will be folded about the fold lines 34, 36, bringing the pocket panels 28, 32 in a position adjacent to the associated major panels 26, 30. If the reinforcing strip 42 were to overhang the lower edge 44, the reinforcing strip 42 could adhesively secure the pocket panels 28, 32 to their associated major panels 26, 30, thereby closing the pocket 22 and preventing access to the pockets 22 and/or present an exposed adhesive surface. It should be understood that spacing the other reinforcing strip or components from the adjacent edges, as described and shown below in various other embodiments, can provide the same or similar advantages.

The reinforcing strip 42 can be made of a variety of materials, including but not limited to paper, paperboard, kraft paper, plastic/polymer in tape or other form, reinforcing materials (such as fiberglass reinforced tape), coatings on the surface of the panels 28, 32, or additives that are applied in liquid form and harden, which can penetrate into and/or reside on top of the blank 24. The reinforcing strip 42 is provided to add greater strength and durability, particularly tear resistance, to those areas wherein the reinforcing strip 42 is present, as compared to the areas of the blank 24 that lack the reinforcing strip 42.

In one embodiment the reinforcing strip 42 is applied in a continuous application process as the blank 24 is formed. For example, with reference to FIG. 2, in one case the blank 24 is moved downstream in the left-to-right direction as it is formed, and a dispenser, roller or the like is utilized to apply the reinforcing strip 42. In this case, the reinforcing strip 42 may extend out to the lateral/outer edges 46, 48 of the blank 24 with no gap therebetween, as shown in FIG. 2. This embodiment can be useful in high-speed manufacturing processes. In particular, in this embodiment the reinforcing strip 42 can be continuously applied to immediately adjacent/abutting blanks 24 during manufacturing, without having to precisely place the reinforcing strip 42 and/or any gaps in the reinforcing strip 42.

Figure 2A:
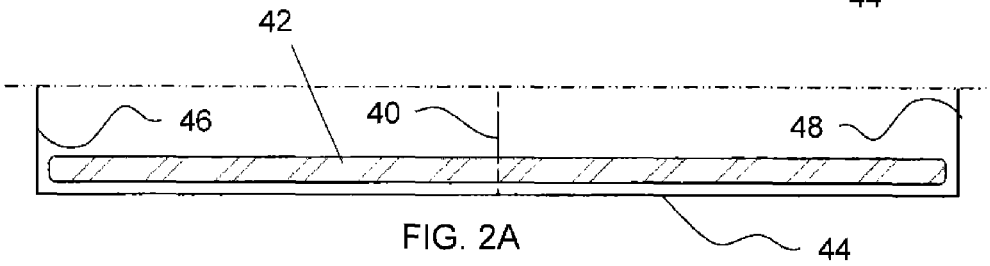
FIG. 2A is a detail view of the alternate lower portion of the blank of FIG. 2.

However, the reinforcing strip 42 may not necessarily extend out to the outer edges 46, 48 of the blank 24. For example, FIG. 2A illustrates a variation wherein the reinforcing strip 42 does not extend entirely to the edges 46, 48 of the blank 24, but instead stops short of the edges 46, 48. This embodiment may be implemented when, for example, the reinforcing strip 42 is applied as a single discrete component (i.e. as a sticker or adhesive) to allow some tolerances on either side of the reinforcing strip 42 during its application.

Figure 3:
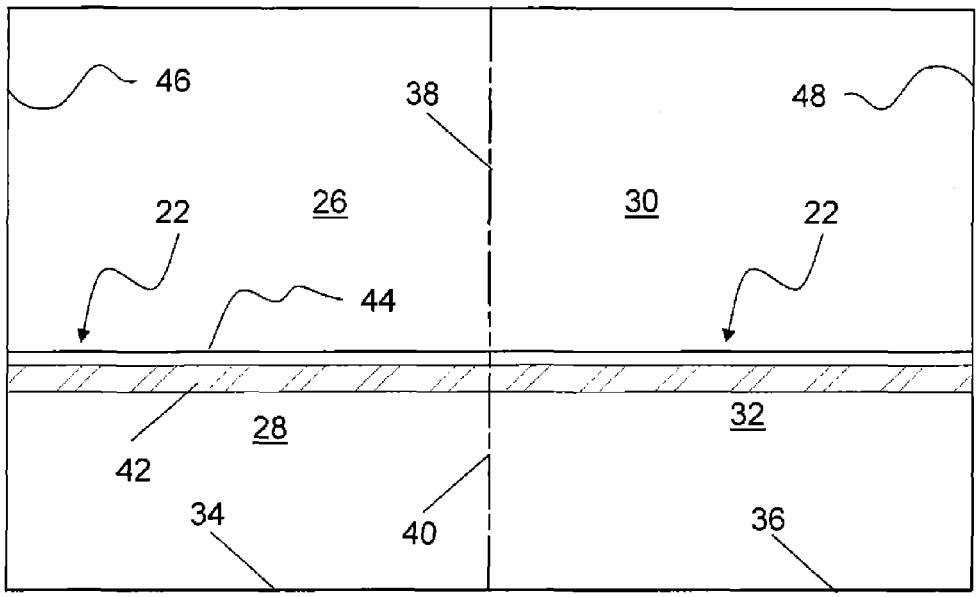
FIG. 3 is a top view of the blank of FIG. 2 after a making a first fold in the process of forming the pocket device.

As shown in FIG. 3, after the blank 24 of FIG. 2 or FIG. 2A is provided, the front pocket panel 28 and back pocket panel 32 are folded over their associated horizontal fold lines 34, 36 (in the illustrated embodiment the panels 28, 32 are folded into the plane of the drawing sheet of FIG. 2, and FIG. 3 shows the back side of the blank 24 of FIG. 2 after such folding). After this folding step the front pocket panel 28 overlies, and forms a pocket 22 with, the front major panel 26, and back pocket panel 32 overlies, and forms a pocket 22 with, the back major panel 30.

Figure 4:
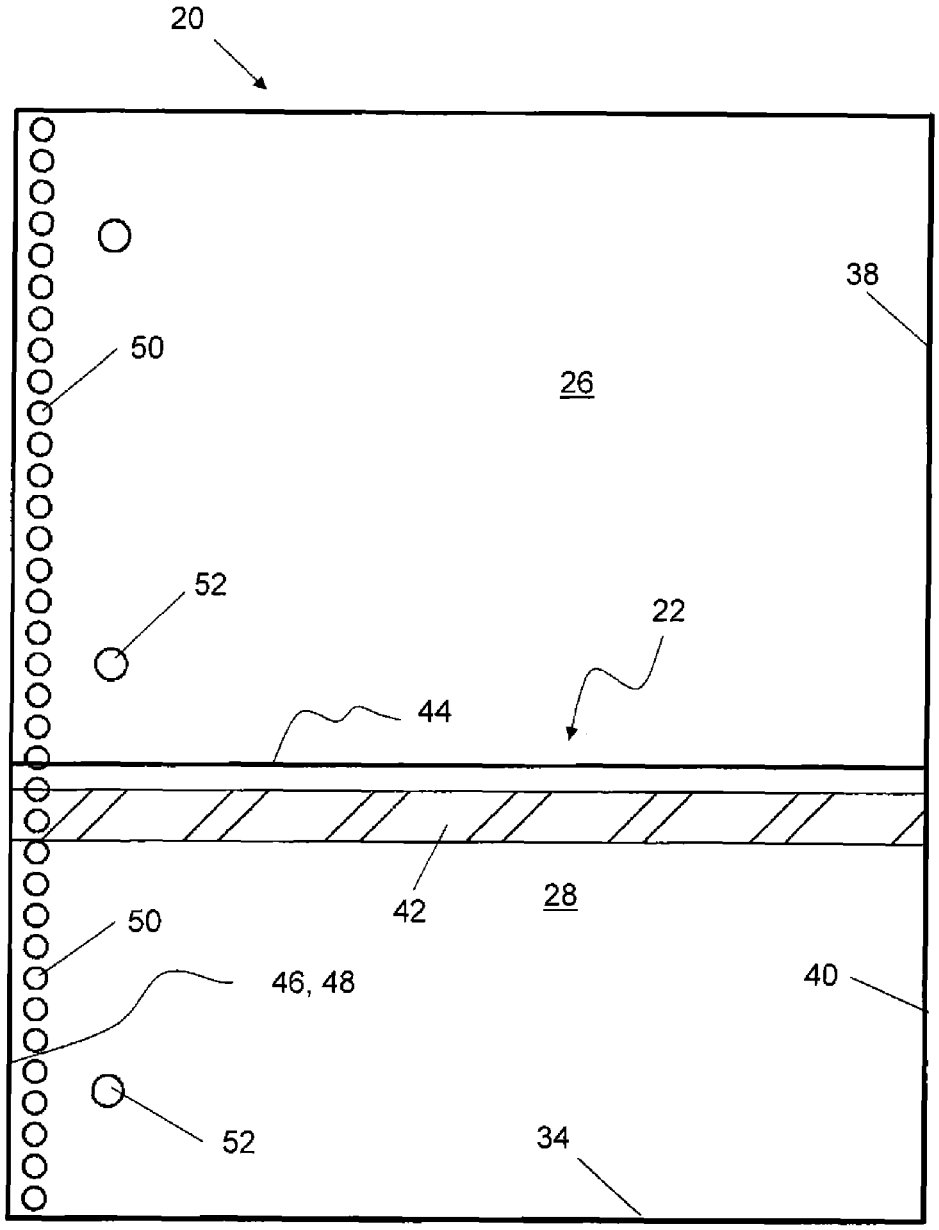
FIG. 4 is a top view of the blank of FIG. 3 after making another fold, forming the pocket device, and with various holes being formed therethrough.

As shown in FIG. 4, the blank 24 of FIG. 3 is then folded outwardly along vertical fold lines 38, 40 causing the major panels 26, 30 to be aligned and flush against each other. In this case the major panels 26, 30 are generally parallel but not co-planar, overlapping in a thickness direction of the pocket device 20. A plurality of coil binding holes 50 (if desired) and ring binding holes 52 (if desired) can then be formed along the inner edges 46, 48 of the blank 24/pocket device 20. The coil binding holes 50 are spaced and configured to receive turns of the binding mechanism 14 therethrough, and the ring binding holes 52 are spaced and configured to receive the rings of a ring binder (not shown) therethrough. In one embodiment, the pocket device 20 may include the ring binding holes 52 and not the coil binding holes 50.

The pocket device 20 can then be used in a notebook 10 (FIG. 1), binder, or other device. The reinforcing strip(s) 42 provide increased strength and durability to the pocket device 20. In particular should the edges 44 of the pockets 22/pocket panels 28/32 tear or begin to tear, the reinforcing strip(s) 42 can slow, retard, or stop such tearing, thereby extending the useful life of the pocket device 20. Since the reinforcing strips 42 extend along the entire lateral width of the pocket 22, or nearly the entire width, the pocket 22 is reinforced at a variety of potential tearing locations.

In the embodiment shown in FIGS. 1-4, the reinforcing strip 42 is positioned adjacent to, but slightly spaced away from the mouth/edge 44 of the associated pocket panel 28/32. In one case, the entire length of the reinforcing strip 42 is spaced away from the associated edge 44. In one case, all or at least part of, or the upper edge, the reinforcing strip 42 is positioned within the upper 10% of the height of the associated pocket panel 28/32, or within about 10% of the dimension of the associated panel extending in a direction perpendicular to the reinforcing strip 42 to be sufficiently close to the edge 44 to prevent significant tearing that would affect the functionality of the pocket 22. All, or part, or an upper edge of the reinforcing strip 42 may be spaced apart from the edge 44 by at least about 1% of the height of the associated pocket panel 28/32 to provide sufficient clearance.

Each pocket 22, along with the associated mouth and edge 44, can extend an entire dimension (i.e. the entire width) of the pocket device 20, major panel 26/30 and pocket panel 28/32 (i.e. from one outer edge 46/48 on the outer perimeter to another outer edge 38/40 (fold lines 38/40 form edges in the formed pocket 22)), and the reinforcing strip 42 can be similarly positioned. In addition, the reinforcing strip 42 may be internally positioned on the pocket device 20 such that the reinforcing strip 42 is not positioned adjacent to, and is instead spaced apart from any outer edges (bottom edge 34 or top edge) of the pocket device 20 that are parallel to the reinforcing strip 42. In one case the reinforcing strip 42 may be spaced apart from the bottom 34 and top edges by at least about 10% of the height dimension of the pocket device 20 (the height dimension extending between the bottom 34 and top edges). The reinforcing strip 42 may extends across the entire width of the pocket device 20 (between edges 46/48 and edge 38) in a direction parallel to the reinforcing strip.

As outlined above, it may be desired to have the reinforcing strip 42 spaced slightly away from the edge 44 to allow for manufacturing tolerances during application of the strip 42. However, in some cases the reinforcing strip 42 may extend up to the edge 44 with no gap therebetween due to superior alignment capabilities, and/or by trimming the excess of the reinforcing strip 42 when forming the blank 24, or folding the portion overlapping excess of the strip 42 over the adjacent edge, or by utilizing other manufacturing techniques.

As noted above, a comparison between FIGS. 2/2A and FIG. 3 reveals that the front pocket panel 28 and back pocket panel 32 shown in FIGS. 2 and 2A are folded about the fold lines 38, 40 rearwardly into the plane of the sheets of FIGS. 2 and 2A, resulting in the arrangement shown in FIG. 3 in which case the reinforcing strip 42 is positioned outside the pockets 22. However, the direction of folding can be reversed such that the front pocket panel 28 and back pocket panel 32 of FIGS. 2 and 2A are folded forwardly out of the plane of the sheets of FIGS. 2 and 2A, in which case the reinforcing strip 42 is positioned inside the pockets 22. Moreover, if desired reinforcing strips 42 can be positioned on both sides of the blank 24, in which case a reinforcing strip 42 is positioned both internally to and externally of the pockets 22 once the pocket device 20 is formed.

Figure 5:
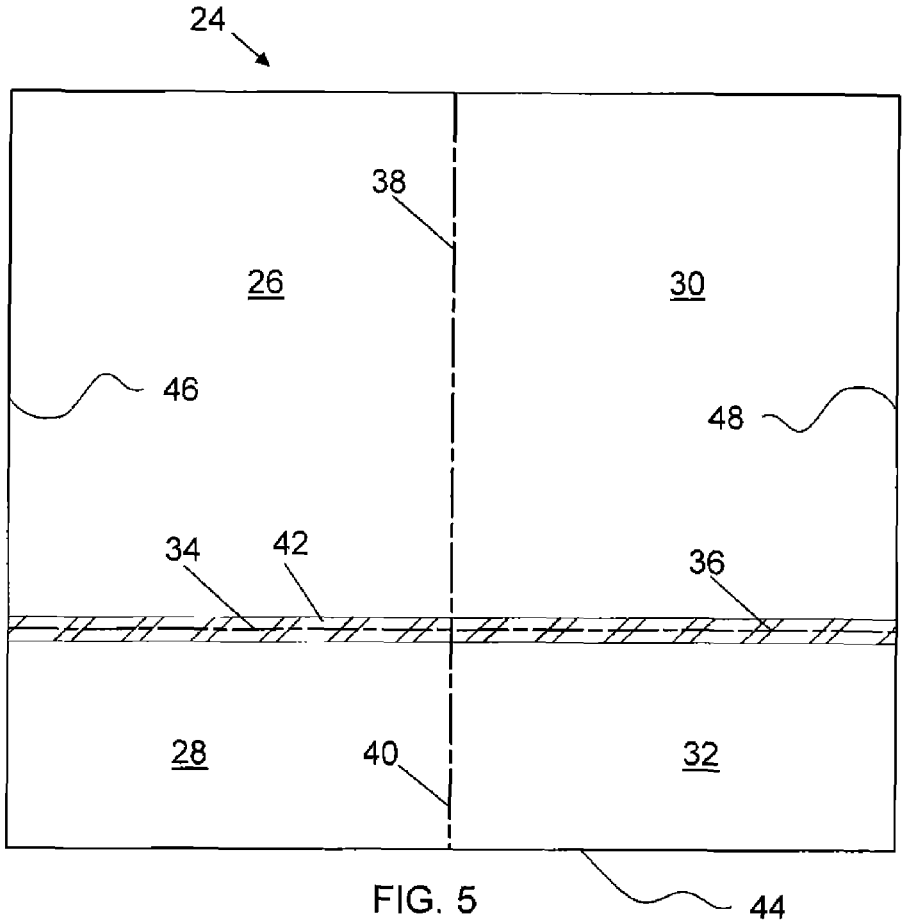
FIG. 5 is a top view of another blank which can be used to form a pocket device, the blank having a reinforcing strip along a fold line of the blank.

FIG. 5 shows a blank 24 for forming an alternate pocket device, which is reinforced in a different manner from the pocket device shown in FIGS. 1 and 4. In particular, in this embodiment the blank 24 includes a reinforcing strip 42 positioned along (e.g. parallel with, overlapping and/or coincident with) pocket/horizontal fold lines 34, 36. As shown in FIG. 5, the reinforcing strip 42 may extend right up to the edges 46, 48 of the blank 24 with no gap therebetween, or as shown in FIG. 5A, the outer ends of the reinforcing strip 42 may be spaced away from the edges 46, 48.

The blank 24 of FIG. 5 is formed into a pocket device 20 using the same steps as outlined above for the blank 24 and shown in FIGS. 2 and 3. Once the front pocket panel 28 and back pocket panel 32 are folded over along horizontal fold lines 34, 36 to form the pockets 22, the reinforcing strip 42 is positioned at the bottom of the pockets 22, and ultimately at the bottom of the pocket device 20. Thus, in this embodiment the reinforcing strip 42 provides additional strength along the bottom of the pockets 22/pocket device 20.

Figure 5A:
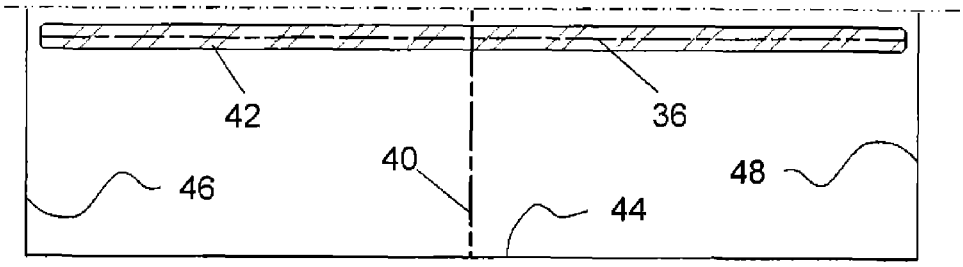
FIG. 5A is a detail view of an alternate lower portion of the blank of FIG. 5.

It should be understood that the front pocket panel 28 and back pocket panel 32 shown in FIGS. 5 and 5A can be folded about the fold lines 34, 36 in either direction; that is, either forwardly out of the plane of the drawing sheets of FIGS. 5 and 5A (in which case the reinforcing strip 42 is positioned inside the pockets 22), or rearwardly into the plane of the drawing sheets of FIGS. 5 and 5A (in which case the reinforcing strip 42 is positioned inside the pockets 22); or a reinforcing strip 42 can be positioned on both sides of the fold lines 34, 36.

Figure 6:
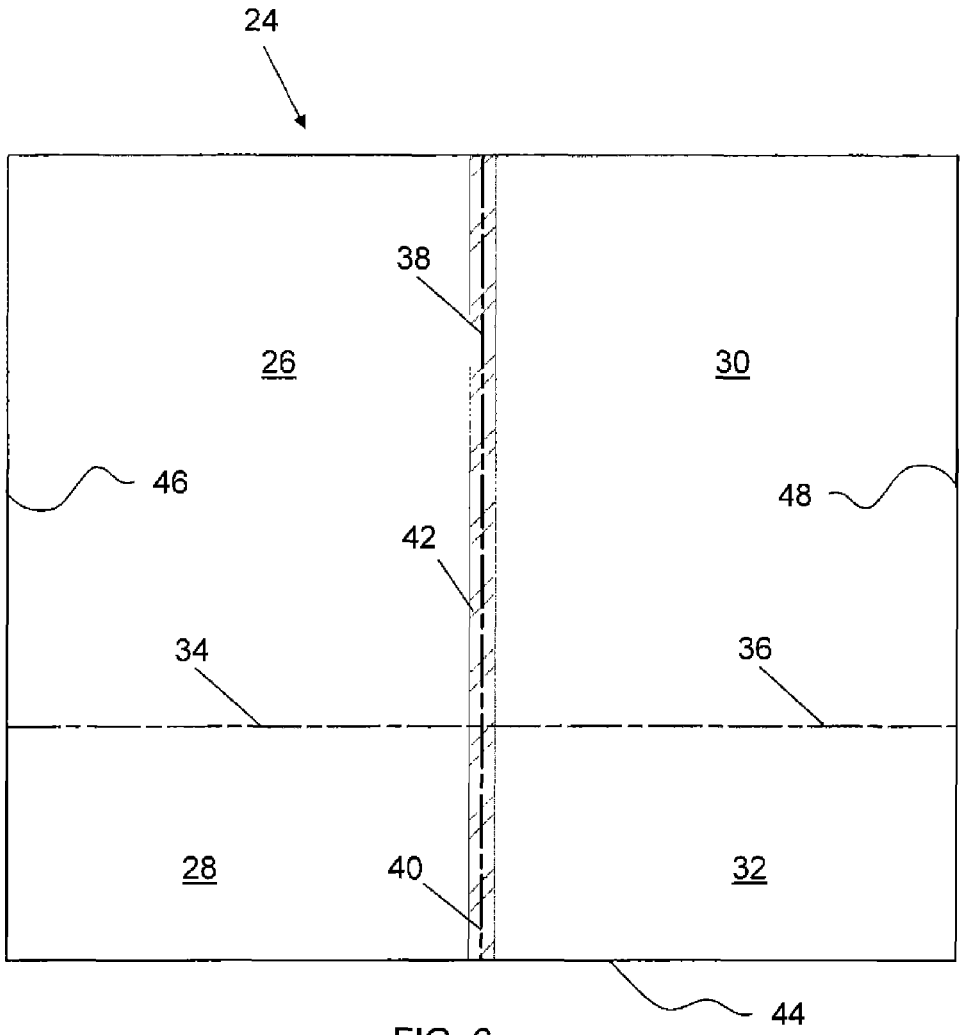
FIG. 6 is a top view of another blank which can be used to form a pocket device, the blank having a reinforcing strip along a central fold line.

FIG. 6 shows a blank 24 for forming an alternate pocket device. In this embodiment the blank 24 includes a reinforcing strip 42 positioned along (e.g. parallel, overlapping and/or coincident with) the vertical fold lines 38, 40. Thus, in this embodiment the reinforcing strip 42 provides additional strength at the spine of the pocket device 20, once the pocket device 20 is formed. As is the case with the other embodiments disclosed above, the blank 24 of FIG. 6 can be folded in either direction to provide an internally positioned, or externally positioned, (or both) reinforcing strip 42. Moreover, as in the embodiment described above, the reinforcing strip 42 may extend to the bottom 44 and/or top edges of the blank 24, or may be spaced slightly inwardly from the edges.

Figure 7:
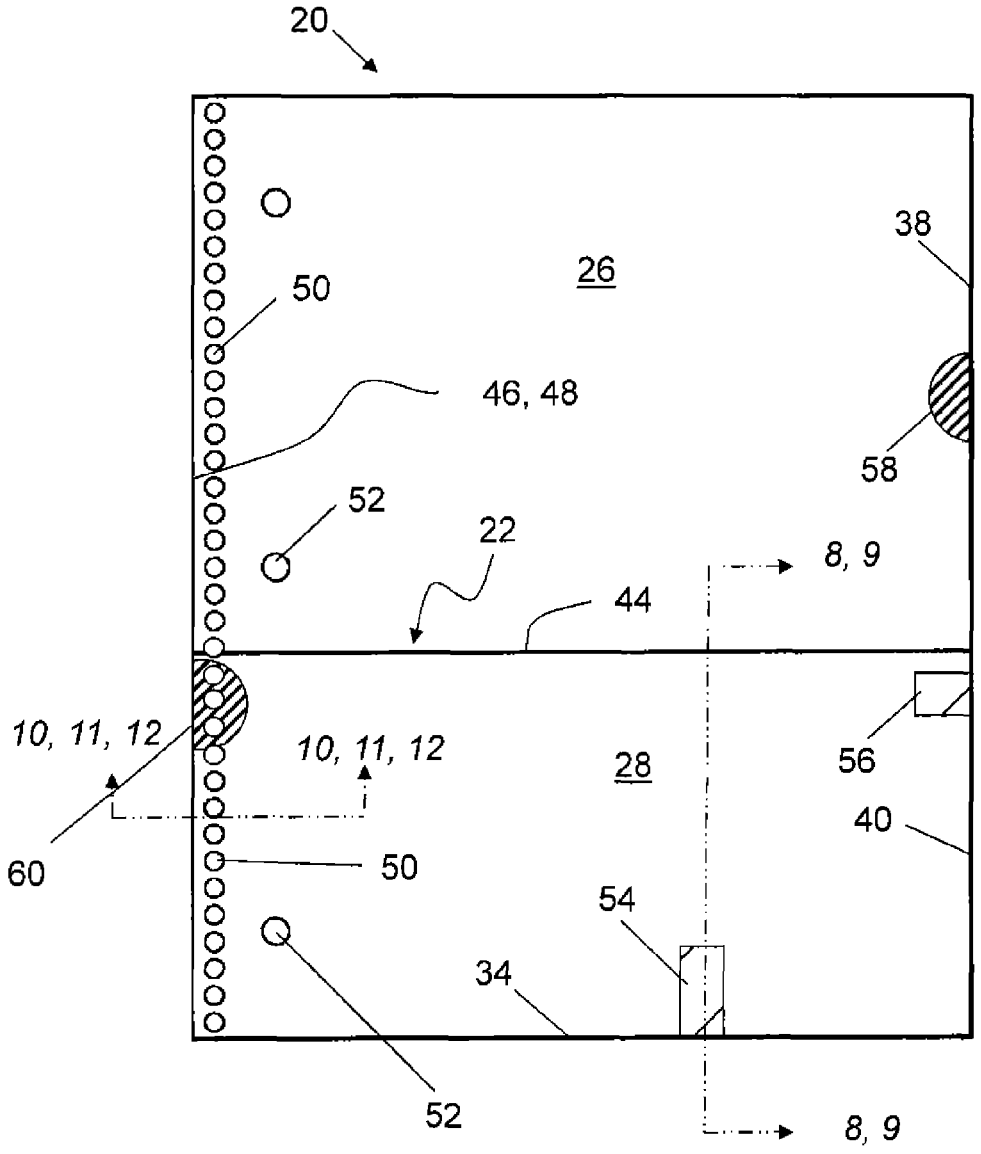
FIG. 7 is a top view of another pocket device with various reinforcing strips and components.
Figure 8:
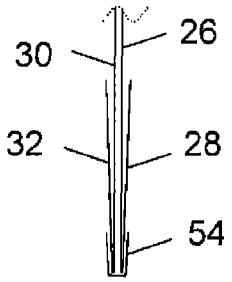
FIG. 8 is a cross section taken along the line indicated in FIG. 7, illustrating one particular configuration of a reinforcing strip.

FIG. 7 shows another pocket device 20, with a relatively short, vertically-extending reinforcing strip 54 applied across lower edge 34 of pocket device 20 so that the strip 54 can strengthen the bottom of the pocket device 20. As shown in FIG. 8, in one embodiment the strip 54 is positioned on external surfaces of the pocket device 20 such that one end of the strip 54 is positioned on the front pocket panel 28, and the other end of the strip 54 is positioned on the back pocket panel 32. In this case the strip 54 reinforces both fold lines 34 and 36 and helps to retain the pocket device 20 in its folded position. In this case the reinforcing strip 54 may be added to the pocket device 20 after the associated blank is folded along the major or vertical fold lines 38, 40.

Figure 9:
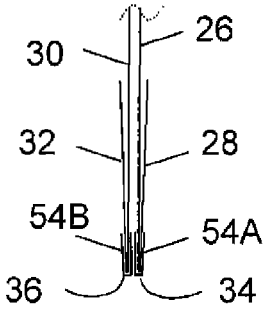
FIG. 9 is a cross section taken along the line indicated in FIG. 7, illustrating an alternate configuration of the reinforcing strip.

Alternately, as shown in FIG. 9 a first reinforcing strip 54A could be wrapped around only the front pocket 22, that is, only fold line 34, such that the reinforcing strip 54A is attached to the front pocket panel 28 at one end and the major front main panel 26 at its other end. Likewise, as shown in FIG. 9, a similar reinforcing strip 54B could be wrapped around the lower edge 36 of the back pocket 22, that is, the reinforcing strip 54B extends from back pocket panel 32, around the fold line 36, and onto the back major panel 30. The reinforcing strips 54A, 54B shown in FIG. 9 could be applied at any stage of forming the pocket device 20, although for an automated assembly process it might be easier to apply the reinforcing strips 54A, 54B before the associated blank is folded along the major or vertical fold lines 38, 40. While the reinforcing strips 54A, 54B are shown positioned on the outside of the pocket 22 or various panels, the reinforcing strips 54A, 54B could instead be positioned inside the pocket 22 or various panels, or both on the outside and inside.

The pocket device 20 of FIG. 7 further includes a relatively short, horizontally-extending reinforcing strip 56 applied across a side edge 40 of pocket 22 so that the strip 56 can strengthen the side of the pocket 22. The strip 56 can be formed in the same configurations as disclosed above for the strip 54. Reinforcing strips 54 (at the bottom of the pocket device 20) and 56 (at the folded side 38, 40 of the pocket device 20) may be used alone or in combination. The reinforcing strips or materials 54, 56 shown in FIG. 7 and elsewhere may be rectangular as shown, or may be circular (for example, see adhesive reinforcing material 58 wrapped around the fold 38) or any other shape according to manufacturing, design, or other preference.

Figure 10:
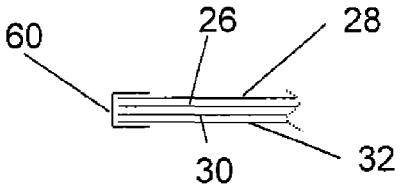
FIGS. 10, 11 and 12 are cross sections taken along the line indicated in FIG. 7, illustrating various configurations of a reinforcing strip.
Figure 11:
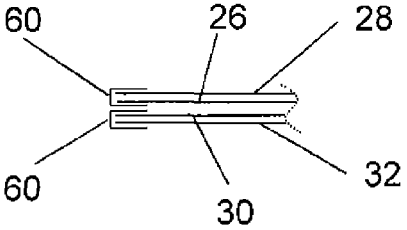
Figure 12:
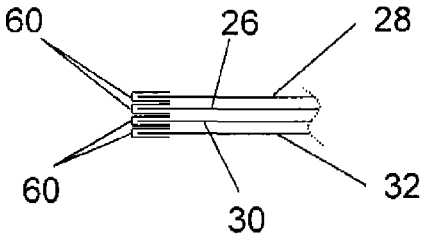

The reinforcing strips can also be positioned along various other edges, such as the inner edges 46, 48, as shown by reinforcing material 60 shown in FIG. 7. The reinforcing material 60 (or multiples of the reinforcing material 60) can be positioned on the outer-most surfaces of the pocket device 20 (e.g. on the outer surfaces of the pocket panels 28, 32, as shown in FIG. 10), and/or around each pocket 22 (around panels 26/28 and 30/32, as shown in FIG. 11), and/or around each individual panel 26, 28, 30, 32 (as shown in FIG. 12). In this particular embodiment the reinforcing material 60 is located at or adjacent to an upper inner corner of the pockets 22, which can be an area of high stress.

Figure 13:
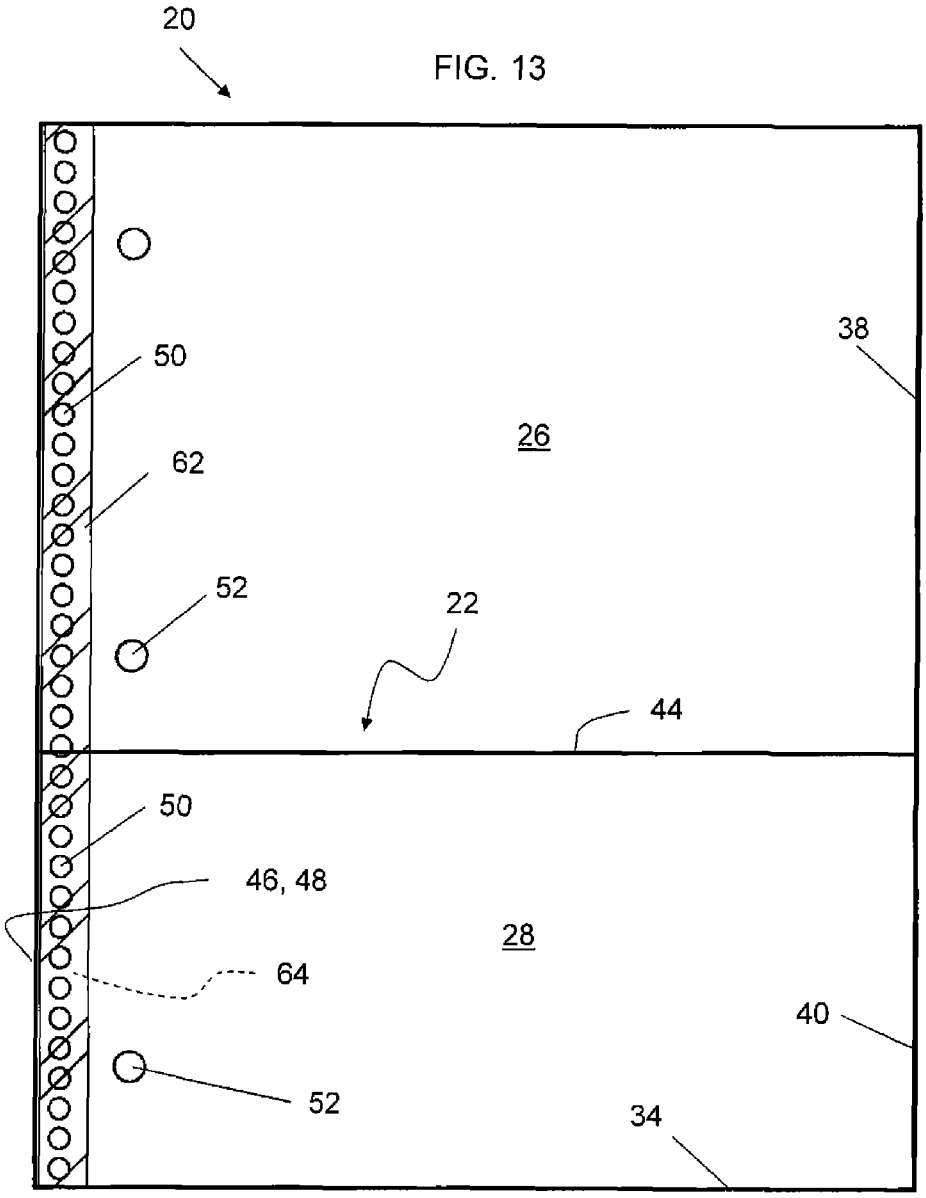
FIG. 13 is a top view of another pocket device with a reinforcing strip along its binding holes.

FIG. 13 shows another pocket device 20 having a reinforcing strip 62 applied along the binding edge 46, 48 and along binding holes 50. The reinforcing strip 62 may be abutted against the inner edge 46, 48, or may be spaced slightly inwardly away from the adjacent inner edge 46, 48. The holes 50 may be formed after the reinforcing strip 62 is applied such that the holes in the reinforcing strip 62 are necessarily aligned with the holes 50 in the body of the pocket device 20. Alternately, the holes may be formed prior to attaching the reinforcing strip 62 and aligned during application.

The reinforcing strip 62 may be applied on any or all the various surfaces of the major panels 26, 30 and pocket panels 28, 32, and in various combinations thereof. For example, in one case a single reinforcing strip 62 is applied to the exposed front and/or back surface of one or more of the panels 26, 30, 32, 34. Alternately, a reinforcing strip 62 can be applied to applied to the entire front and/or back surface of one or more of the panels 26, 30, 32, 34. The reinforcing strip 62 can be wrapped around the inner edges 46, 48 if desired. The reinforcing strip 62 may extend right up to the upper and lower edges of the pocket device 20 with no gap therebetween, or the ends of the reinforcing strip 62 may be spaced away from the edges upper and/or lower edges.

It is noted that the lower portion of the inner edge 64 of the major panel 26 is covered by the pocket panel 28. This covered edge 64 of the major panel 26 may lack a reinforcing strip 62, but if desired the covered edge 64 can be further reinforcing by applying a reinforcing strip 62 to the covered edge 64. Conversely, the inner surface/covered edge of the pocket panel 28 can either lack or include a reinforcing strip 62. Similar arrangements apply to the back panels 30, 32.

Reinforcing strips 42, 54, 56, 58, 60 and 62, and others, may be used alone or in any combination. Multiple reinforcing strips can be applied along any one of the panels 28, 30, 32, 34 in a spaced-apart or abutting, parallel or non-parallel relationships. Long reinforcing strips such as strips 42 (or others) may be applied along an entire length of the underlying structure, or may be skip-applied in partial sections. Reinforcing strips, including but not limited to those explicitly shown herein, may be applied on any surface of the pocket device (e.g. a hidden or inward surface, or an external surface or surface that faces outward in the finished product, or on both inward and outward surfaces) as desired to provide desired strengthening qualities.

The coil binding holes 50 and ring binding holes 52 may be made at any stage in the forming/manufacturing process, including in the associated blank 24 before folding, or after making either of the folds along the fold lines 34/36 or 38/40, or even after assembling the pocket device 20 for example into a stack of materials (covers, pages, pocket device(s), etc.). If reinforcing material is applied where there are or will be holes, the material may be applied before the holes are made for ease of assembly. When the pocket device 20 is assembled manually the time at which holes 50, 52 are formed may not matter. For automated or machine assembly it may be advantageous to create holes 50, 52 after pocket device 20 has been folded as shown in FIG. 4, or after assembling a stack of materials to create a notebook or the like, to ensure the holes are properly aligned.

As noted above, the pocket devices 20 described herein may be bound into a binding mechanism 14 using holes 50 or into a ring binder using holes 52, or may be bound into another structure such as a sewn, glued or stapled binding (for example along the edges 46, 48). Alternately the pocket device 20 may be used as a standalone device, with the inner edges 46, 48 being either completely free, or having one or both pocket panel 28, 32 coupled to their associated major panel 26, 30 along the inner edges 46, 48. The major panels 26, 30 may be attached to each other along the inner edges 46, 48, or may be unattached. Further alternately, all panels 26, 28, 30, 32 may be coupled together along the inner edges 46, 48. The panels 26, 28, 30, 32 or parts thereof can be coupled together by a variety of methods, such as heat welding, sonic welding, stitching, adhesives, staples, rivets or other mechanical fasteners, etc. Moreover, while the pocket devices shown herein have two pockets 22, a pocket device with only a single pocket 22 (i.e. with only panels 26, 28) can be utilized.

Figure 14:
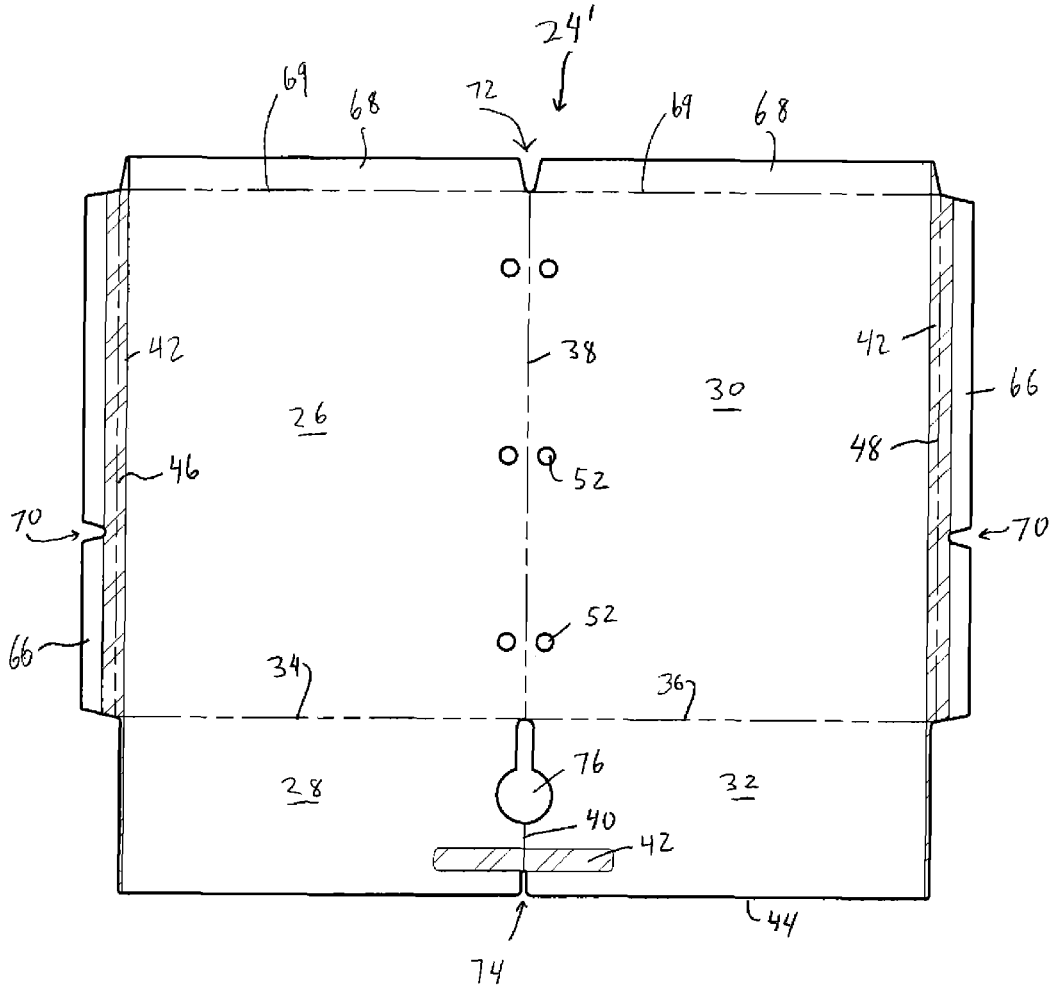
FIG. 14 is a top view of a blank that can be used to form a pocket device.

FIGS. 14-23 illustrate various other embodiments of a pocket device 20' and/or a blank 24' for forming a pocket device 20'. The blank 24' shown in FIG. 14 is similar to the blank 24 of FIG. 2 and includes the front major panel 26, front pocket panel 28, back major panel 30, back pocket panel 32, front pocket fold line 34, back pocket fold line 36, major vertical fold line 38 and minor vertical fold line 40 in generally the same manner as outlined above. The blank 24' of FIG. 14 may also include a pair of opposed side flaps 66, each foldable about an associated fold line 46, 48 and a pair of upper flaps 68, each foldable about an associated fold line 69.

Figure 15:
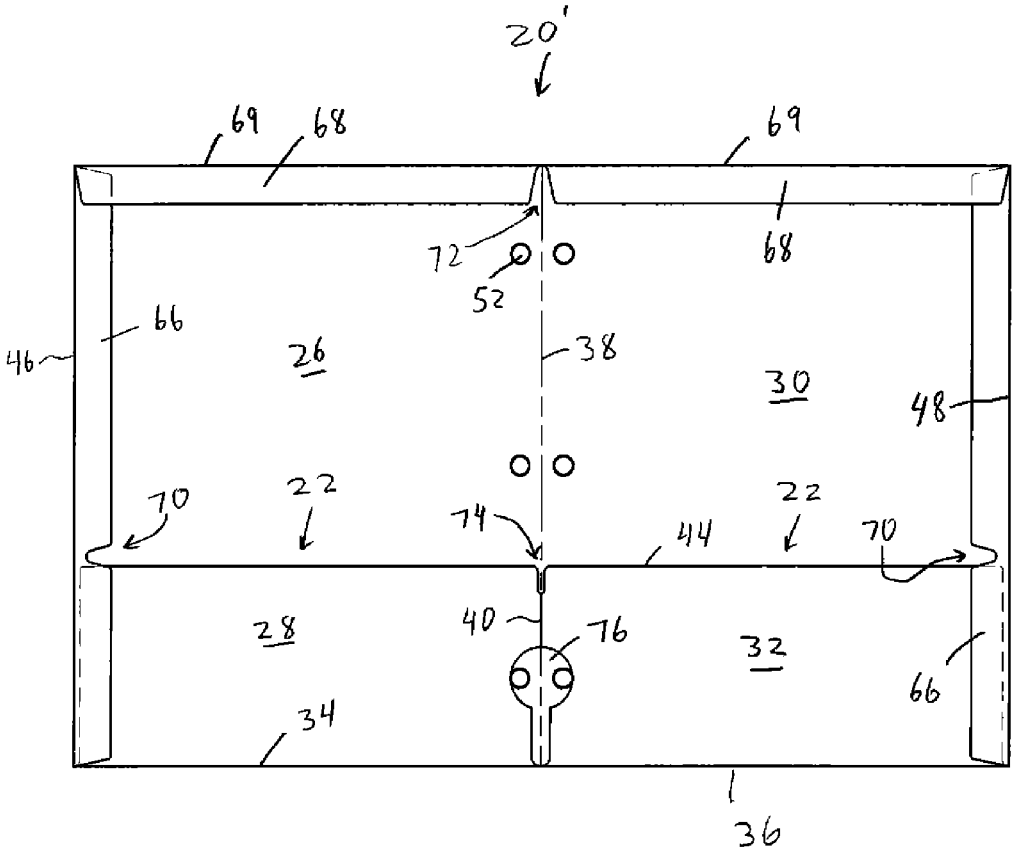
FIG. 15 is a top view of a pocket device that can be formed from the blank of FIG. 14.

Each side flap 66 can have a notch 70 formed therein, which is configured to be aligned with the edge 44 when the pocket device 20' is formed, as shown in FIG. 15. A notch 72 is positioned between the upper flaps 68 and aligned with the major fold line 38. A notch 74 may be positioned between the pocket panels 28, 32, aligned with the minor fold line 40. A generally "key" shaped cut-out or opening 76, including a circular portion and a vertically extending portion, may be formed/positioned in the pocket panels 28, 32, aligned with the minor fold line 40 and adjacent the pocket fold lines 34, 36. The notches/openings 70, 72, 74, 76 help to provide increased flexibility, ease of opening/closing and/or improved storage capacity to the pocket device 20'. In addition, in the illustrated embodiment the blank 24' has the three ring binding holes 52 pre-formed therein.

The blank 24' of FIG. 14 includes a reinforcing strip 42 extending along and covering each of the fold lines 46, 48, positioned on/between the side flaps 66 and the associated major panel 26, 30. As can be seen, part of the distal portions of the reinforcing strip 42 may also be applied to/positioned on the outer edges of the upper flaps 68 and the pocket panels 28, 32. A reinforcing strip 42 is also applied on the pocket panels 28, 32, parallel to the fold lines 34, 36, just above the notch 74 and below the cut-out 76.

In order to form the pocket device 20' from the blank 24' of FIG. 14, the pocket panels 28, 32 are folded about the pocket fold lines 34, 36 until the pocket panels 28, 32 lie flush against the associated major panels 26, 30, forming the pocket 22 therebetween. The side flaps 66 are then folded inwardly about the fold lines 46, 48 on top of the major panels 26, 30 and pocket panels 28, 32, and adhered or otherwise secured in place. The upper flaps 68 are then folded inwardly about the fold lines 69, on top of the major panels 26, 30 and adhered or otherwise secured in place. The resultant pocket device 20', as shown in FIG. 15, is reinforced along fold lines 46, 48 and just below the notch 74. The pocket device 20' can then be used as a stand-along components, or bound into or used in conjunction with a binding device such as a notebook, binder, etc.

In the illustrated embodiment, the reinforcing strips 42 are positioned inside the pockets 22. However, if desired the blank 24' of FIG. 14 can be folded such that the reinforcing strips 42 are positioned outside the pocket 22, resulting in the pocket device 20' shown in FIG. 16. Further alternately, reinforcing strips 42 are positioned both inside and outside the pocket 22. The same reversibility applies to the various other embodiments described below.

Figure 16:
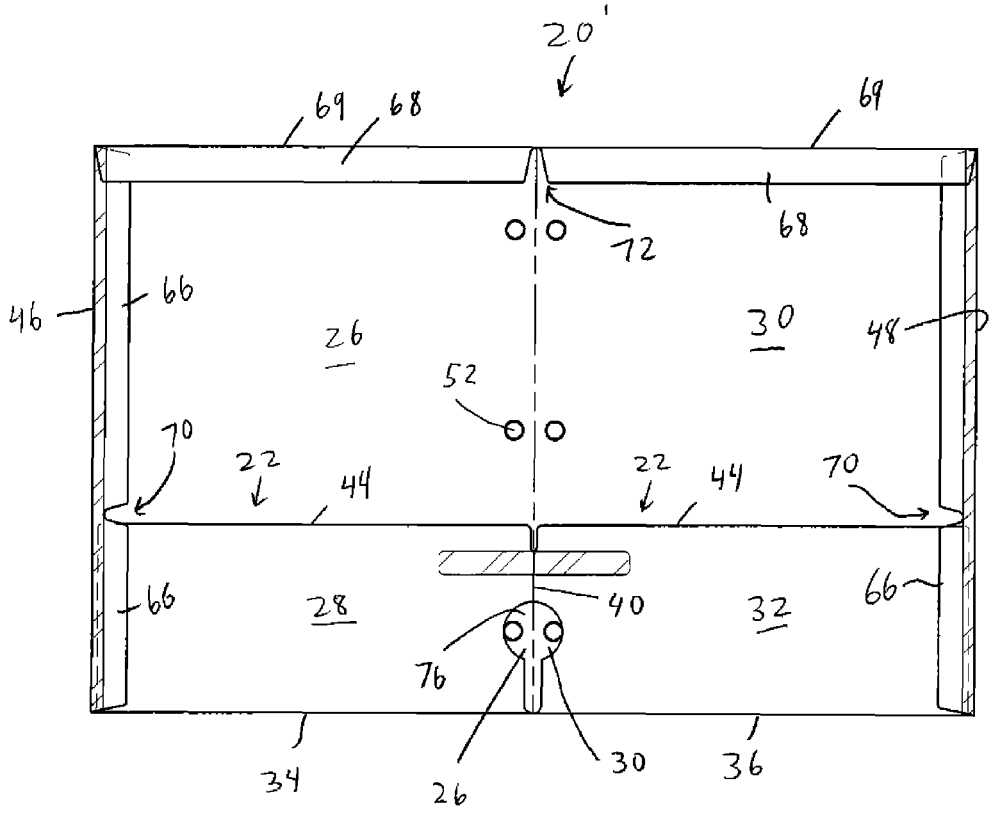
FIG. 16 is a top view of an alternate pocket device that can be formed from the blank of FIG. 14.
Figure 17:
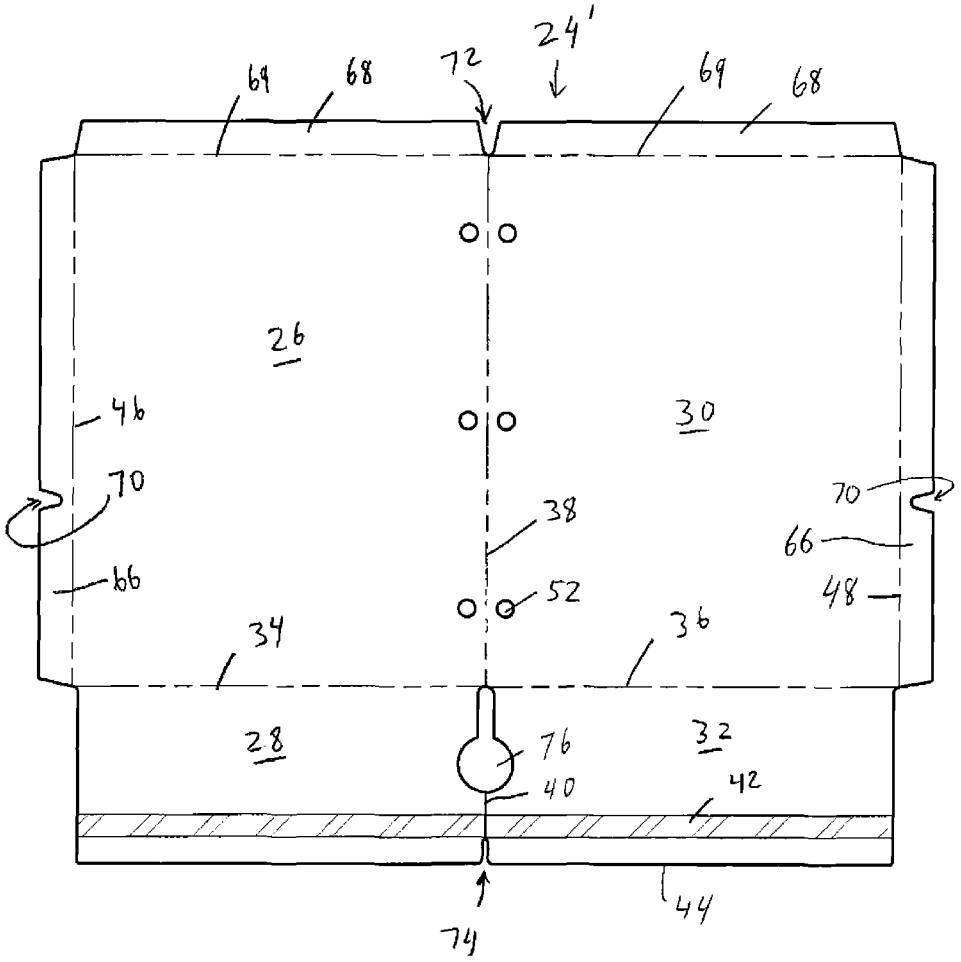
FIG. 17 is a top view of a blank that can be used to form a pocket device.

FIG. 17 illustrates an embodiment similar to that of FIGS. 14-16. However, in this embodiment the reinforcing strips 42 along the fold lines 46, 48 are omitted, and the reinforcing strip 42 on the pocket panels 28, 32 extends substantially the entire width thereof, similar to the embodiment of FIGS. 2 and 2A.

Figure 18:
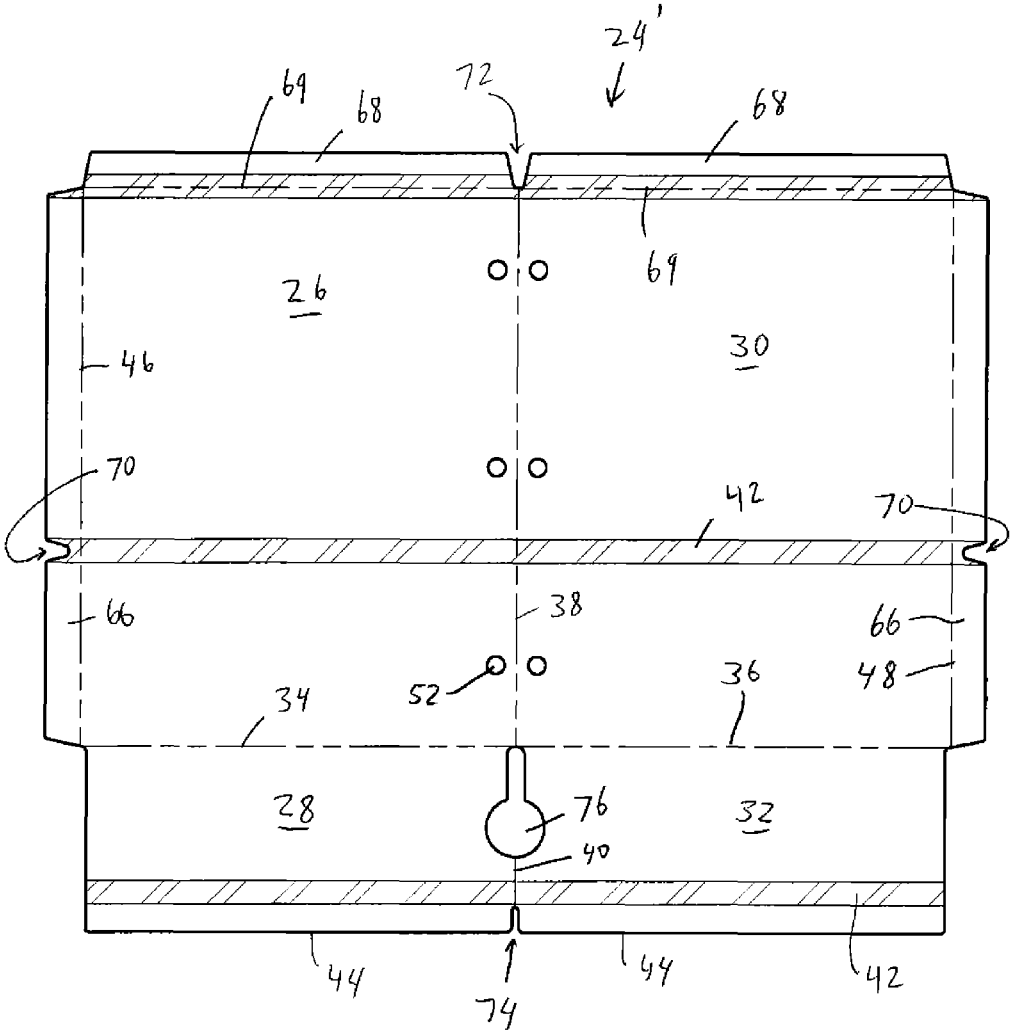
FIG. 18 is a top view of a blank that can be used to form a pocket device.

FIG. 18 illustrates an embodiment similar to FIG. 17, and includes the reinforcing strip 42 on the pocket panels 28, 32 extending substantially the entire width thereof, as disclosed in FIG. 17. The embodiment of FIG. 18 further includes a horizontally/laterally extending reinforcing strip 42 aligned with the notches 70, and another horizontally/laterally extending reinforcing strip 42 aligned and covering the fold line 69. In the embodiment of FIG. 18 each of the reinforcing strips 42 are generally parallel, discrete reinforcing strips/components 42 spaced apart from each other.

Figure 19:
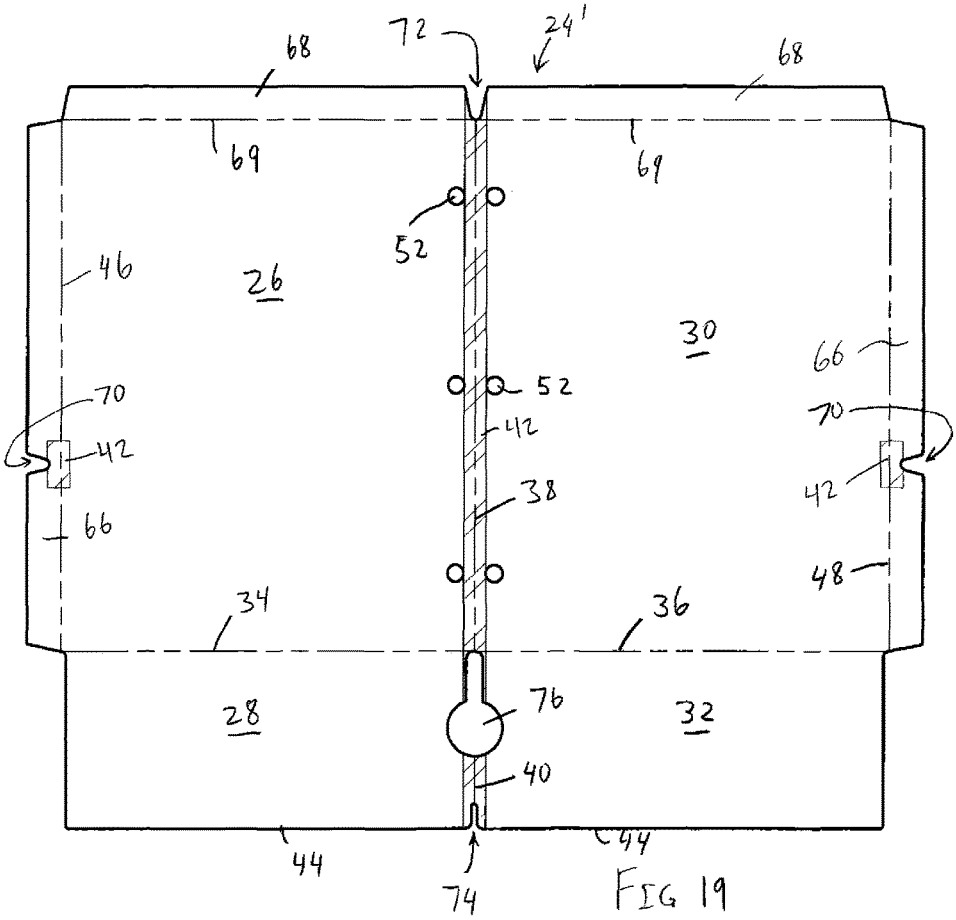
FIG. 19 is a top view of a blank that can be used to form a pocket device.
Figure 19A:
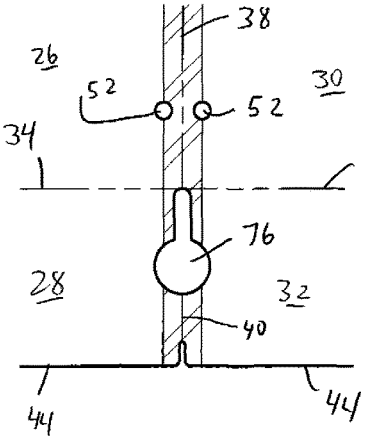
FIG. 19A is a detail view of part of the blank of FIG. 19A, illustrating an alternate construction.
Figure 20:
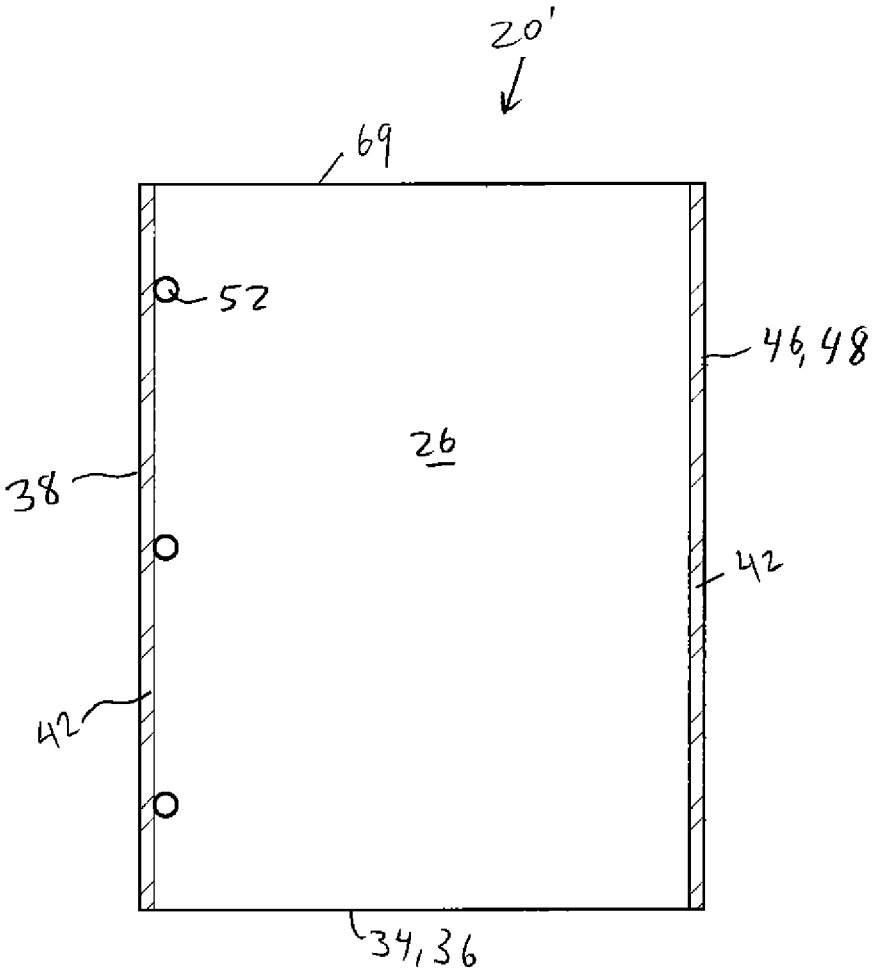
FIG. 20 is a top view of a pocket device, shown in its closed position.

FIG. 19 illustrates an embodiment similar to those of FIGS. 14-18. In this case, however, a reinforcing strip 42 extends along the entire height/length of the fold lines 38, 40 positioned inside/between the binding holes 52. In addition, a short, generally vertically extending reinforcing strip 42 is positioned along fold lines 46, 48 adjacent the notches 70. As shown in FIG. 19A, in one case the center reinforcing strip 42 can extend out to and cover at least part of the perimeter of the binding holes 52. Further alternately, the center reinforcing strip 42 can extend further outwardly and encompass the entire perimeter of the binding holes 52. FIG. 20 illustrates a pocket device 20' with a reinforcing strip 42 along the spine/fold line 38, as shown in FIG. 19, but also includes a reinforcing strip 42 along the outer edges 46, 48.

Figure 21:
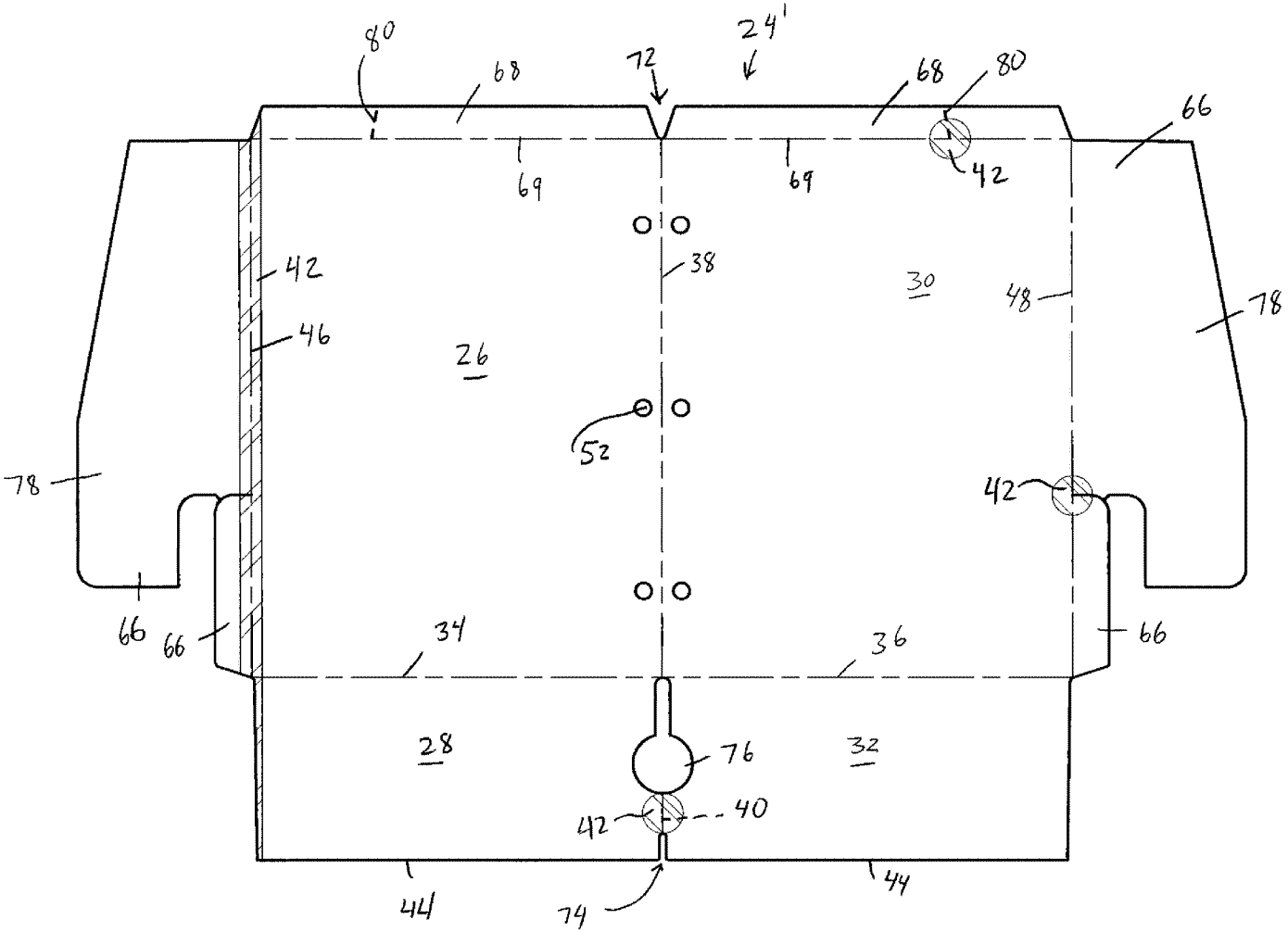
FIG. 21 is a top view of a blank that can be used to form a pocket device.
Figure 22:
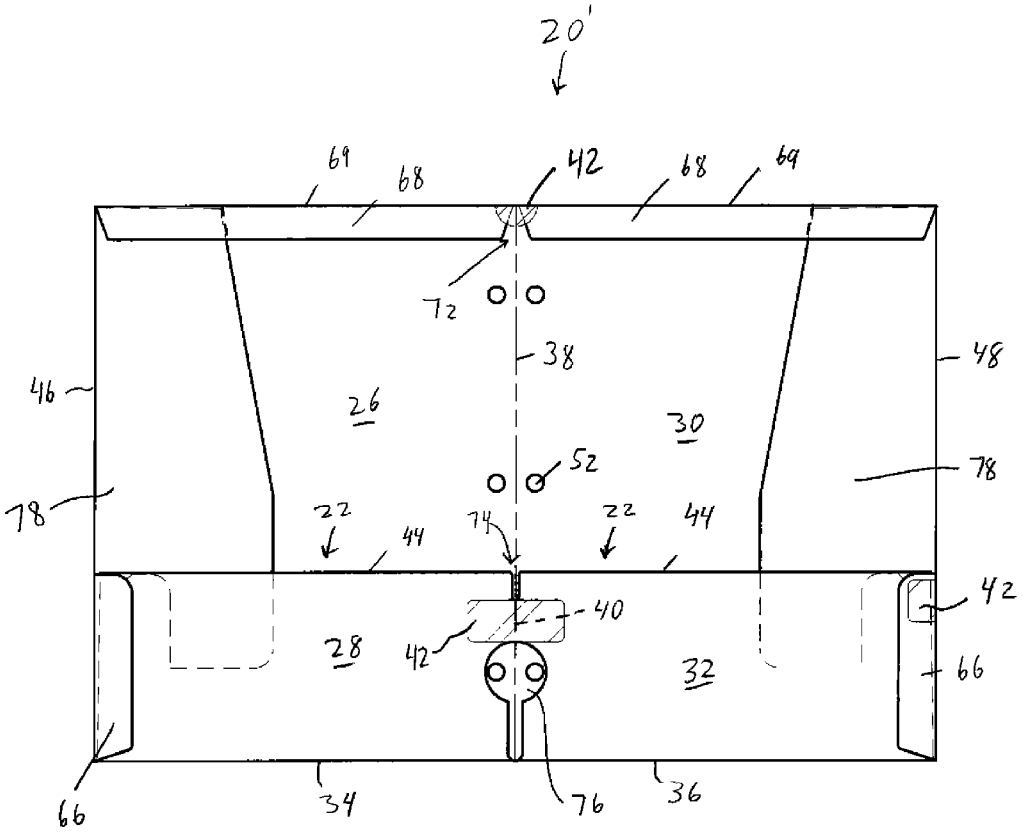
FIG. 22 is a top view of a pocket device that can be formed from the blank of FIG. 21.

FIG. 21 illustrates another form of the blank 24' somewhat similar to the blank 24' of FIG. 14. This case, however, the each side flap 66 includes an outwardly-extending flap divider 78 configured such that when the pocket device 20' is formed, as shown in FIG. 22, at least part of the flap divider 78 is positioned in the associated pocket 22. Each upper flap 68 may include a slit, fold line, perforation line or the like 80 which can allow each flap divider 78 to pivot about the associated fold line 46, 48. FIG. 21 illustrates various exemplary reinforcing strips/materials 42 which can be positioned on the blank 24', such as along fold line 46, along fold line 40 between the cut-out 76 and the notch 74, along the slit 80 and/or upper fold line 69, and along the junction of the flap divider 78 and the remainder of the side flap 66.

FIG. 22 illustrates a pocket device 20' that can be formed from the blank 24' of FIG. 21, with reinforcing materials 42 positioned at differing locations than those shown in FIG. 21. In particular, the pocket device 20' of FIG. 22 includes a reinforcing strip 42 along fold line 69, engaging both upper flaps 68 and part of both major panels 26, 30; reinforcing strip 42 positioned between notch 74 and cut-out 76, at least partially along fold line 40, and reinforcing strip 42 positioned on side flap 66 and major panel 30, covering at least part of fold line 48.

Figure 23:
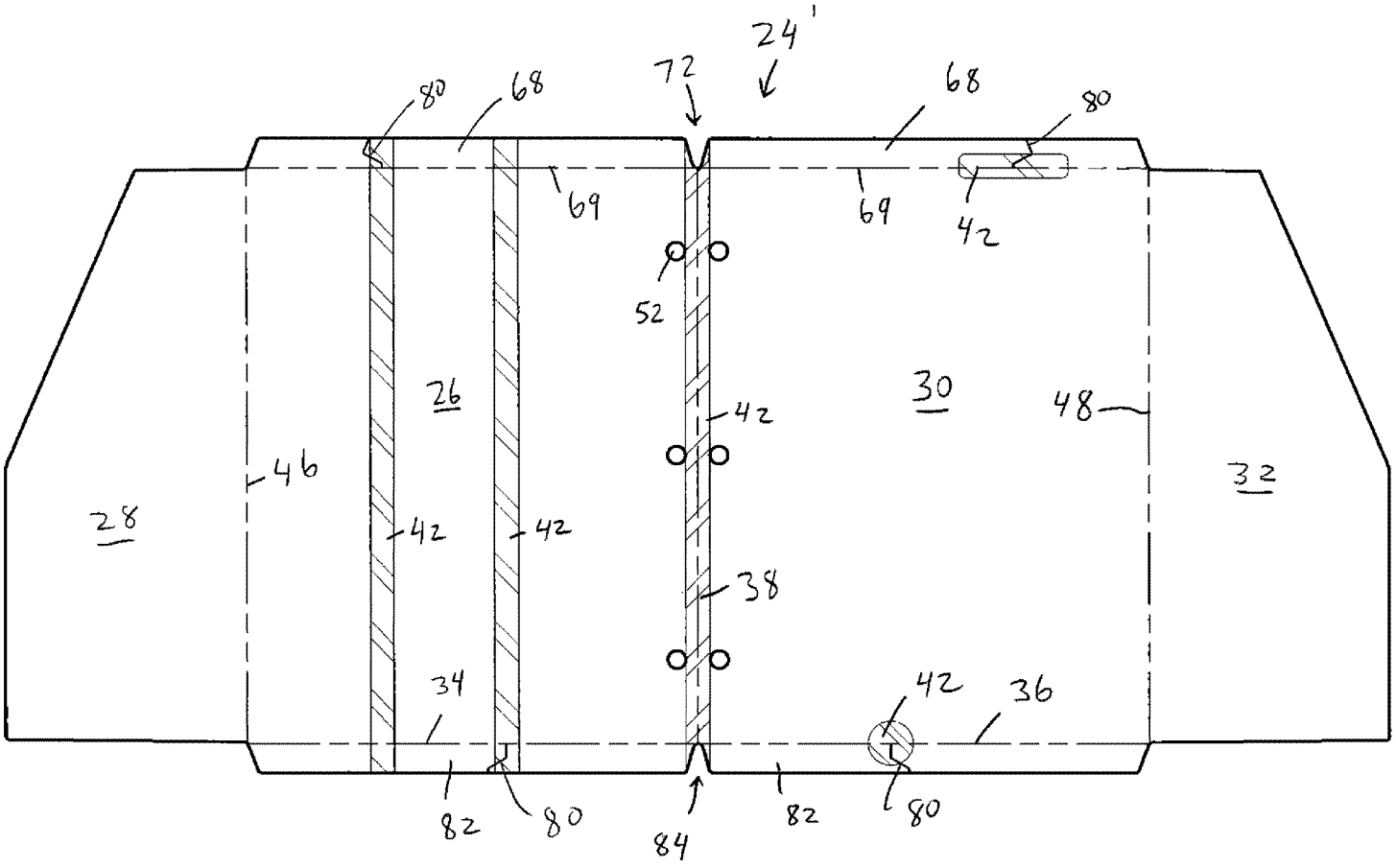
FIG. 23 is a top view of a blank that can be used to form a pocket device.
Figure 24:
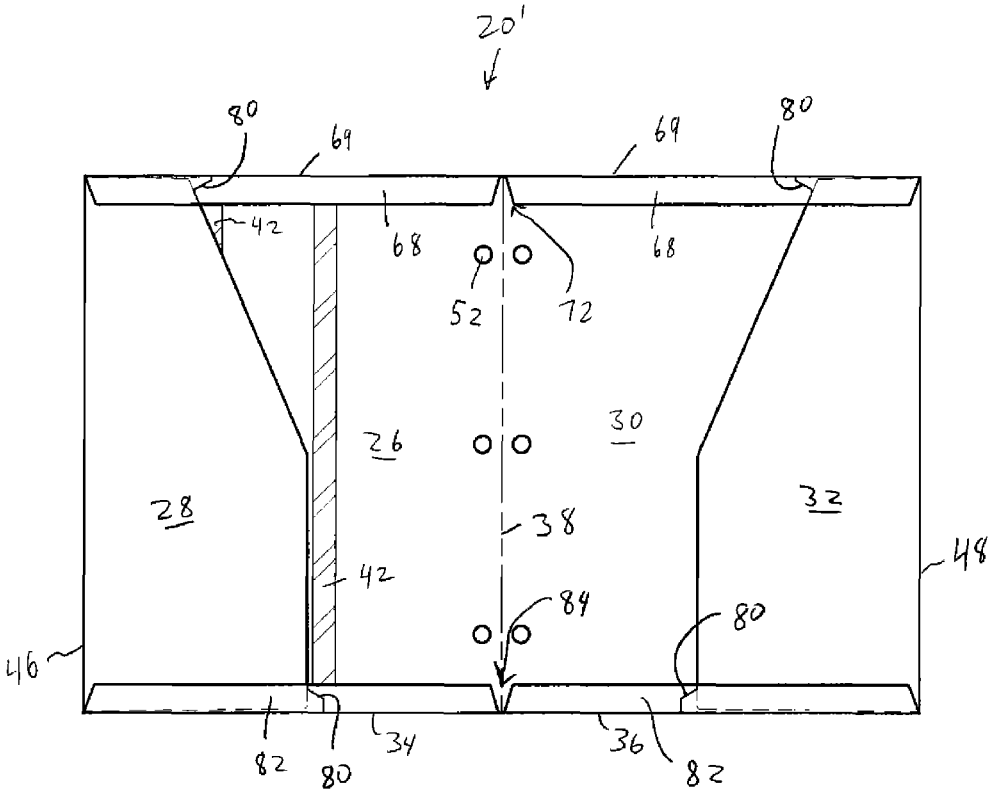
FIG. 24 is a top view of a pocket device that can be formed from the blank of FIG. 23.

FIG. 23 illustrates another blank 24' somewhat similar to blank 24' of FIG. 21. In this case, however, each pocket panel 28, 32 is positioned along the side of each associated major panel 26, 30, and the blank 24' includes a pair of bottom flaps 82 with a notch 84 positioned therebetween. The upper 68 and bottom 82 flaps may each include a slit, fold line, perforation line or the like 80 positioned adjacent to the associated pocket flap 28, 32 when the pocket flap 28, 32 is folded in place, as shown in FIG. 24, which may enable each pocket panel 28, 32 to flex or pivot about the associated fold line 46, 48.

In the embodiment of FIG. 23, the blank 24' includes a pair of spaced apart, generally vertically-extending reinforcing strips 42 extending the entire height of the blank 24', aligned with the slits 80 of the upper 68 and lower 82 flaps, respectively. The blank 24' further includes a vertically extending reinforcing strip 42 extending the entire height/length of the fold line 38. The blank 24' includes a generally horizontally extending reinforcing strip 42, extending along upper fold line 69 and intersecting slit 80 of upper flap 68, and a generally circular reinforcing material 42 extending along lower fold line 36 and intersecting slit 80 of lower flap 82. Of course, differing ones of the disclosing reinforcing materials 42 can be used in various combinations, as desired. FIG. 24 illustrates a pocket device 20' formed from the blank 24' of FIG. 23, including the two vertically extending reinforcing strips 42 extending the entire height of the blank 24'.

It should be noted that the embodiments of FIGS. 14-23 are similar to those of FIGS. 1-13, with one exception that the embodiment of FIGS. 1-13 includes an additional folding step wherein the pocket device 20 is folded about the fold lines 38, 40, effectively folding the pocket device 20 in half. However, if desired the pocket device 20 shown in FIGS. 1-13 may omit this additional folding step, and instead function in the manner shown in the embodiments of FIGS. 14-23 (although additional steps and/or structure may be required to close/seal the outer edges of the pockets 22). Conversely, if desired the pocket device 20' shown in FIGS. 14-23 may be folded in the manner shown in the embodiment shown in FIGS. 1-13, and be utilized in the same manner. Thus any of the features shown in the embodiments of FIGS. 1-13 can be used in those of FIGS. 14-23, and vice versa.

The pocket devices 20, 20' can be used alone, or used in conjunction with, or integrated into, other school and office items, such as binders, notebooks, portfolios, planners, date books, and the like. The reinforcing material can be applied at areas of expected high stresses to improve the durability of the pocket device.

Having described the invention in detail and by reference to the various embodiments, it should be understood that modifications and variations thereof are possible without departing from the scope of the claims of the present application.

What is claimed is:

1. A pocket device comprising:

a first major panel and a second major panel coupled together along a major fold line;

a first pocket panel coupled to said first major panel and defining a first pocket with said first major panel, said first pocket panel having an edge positioned adjacent to a mouth of said first pocket;

a second pocket panel coupled to said second major panel and defining a second pocket with said second major panel, said second pocket panel having an edge positioned adjacent to a mouth of said second pocket;

a first reinforcing material positioned on said first pocket panel adjacent to said mouth of the first pocket, wherein the first reinforcing material is spaced apart from the edge of the first pocket panel; and a second reinforcing material positioned on said second pocket panel adjacent to said mouth of the second pocket, wherein the second reinforcing material is spaced apart from the edge of the second pocket panel, wherein said first and second reinforcing materials each constitute an outermost surface of said pocket device in a thickness direction thereof, wherein the first and second reinforcing materials are each made of a different material than a material of said first major panel, second major panel, first pocket panel or second pocket panel, and wherein said first major panel, said second major panel, said first pocket panel and said second pocket panel each include binding holes extending therethrough, and wherein the pocket device further includes a binding device extending through each of said binding holes, and wherein said first reinforcing material has an edge coincident with at least part of an edge of at least one binding hole of said first pocket panel, and wherein said second reinforcing material has an edge coincident with at least part of an edge of at least one binding hole of said second pocket panel.

2. The pocket device of claim 1 wherein said first and second reinforcing materials are both strips that extends generally parallel to, but are spaced apart from along their entire lengths, the edge of the associated pocket panel.

3. The pocket device of claim 1 wherein the first and second pocket panels each have a height dimension extending generally perpendicular to the associated edge, and wherein each reinforcing material is spaced away to from the associated edge to form a gap with the associated edge that is no more than about 10% of the height dimension in a direction of the height dimension.

4. The pocket device of claim 1 wherein the first and second pocket panels each have a height dimension extending generally perpendicular to the associated edge, and wherein each reinforcing material is spaced apart from the associated edge at least about 1% of the height dimension in a direction of the height dimension.

5. The pocket device of claim 1 wherein each reinforcing material extends along an entire length of the associated mouth.

6. The pocket device of claim 1 wherein each mouth and each edge extend from one outer edge of the associated major panel to another, opposite outer edge of the associated major panel.

7. The pocket device of claim 1 wherein the first major panel, second major panel, first pocket panel and second pocket panel are made of a single, unitary, one-piece sheet of material.

8. The pocket device of claim 1 wherein the first and second reinforcing materials are each a polymer tape.

9. The pocket device of claim 1 wherein the first and second major panels are generally parallel but not co-planar and overlap in a thickness direction of the pocket device such that the first and second pockets are positioned on opposite sides of the pocket device.

10. The pocket device of claim 1 wherein each reinforcing material is generally internally positioned on the pocket device such that each reinforcing material is not positioned adjacent to any outer edges of the pocket device that are parallel to a length of the reinforcing material defined by a longest dimension of said reinforcing material.

11. The pocket device of claim 1 wherein said edge of said first pocket panel at least partially defines said mouth of said first pocket, and wherein said edge of said second pocket panel at least partially defines said mouth of said second pocket, and wherein said first reinforcing material extends substantially an entire length of said edge of said first pocket panel, and said second reinforcing material substantially extends an entire length of said edge of said second pocket panel.

12. The pocket device of claim 1 wherein said edge of said first pocket panel extends along an entire length of said mouth of said first pocket and wherein said edge of said second pocket panel extends along an entire length of said mouth of said second pocket.

13. The pocket device of claim 1 wherein said first and second reinforcing materials are integrally formed together and both together made of a single, unitary piece of material.

14. The pocket device of claim 1 wherein said first and second reinforcing materials each extend across an entire dimension of the pocket device in a plane thereof.

15. The pocket device of claim 1 wherein said pocket device is generally flat and planar and wherein said thickness direction is oriented perpendicular to a plane of said pocket device, and wherein in said thickness direction said first major panel is positioned immediately adjacent to said second major panel, and wherein in said thickness direction said first and second major panels are both positioned between said first pocket panel and said second pocket panel, and wherein in said thickness direction said first pocket panel and said second pocket panel are both positioned between said first reinforcing material and said second reinforcing material.

16. The pocket device of claim 1 wherein said pocket device is generally flat and planar, and wherein said thickness direction extends in a direction perpendicular to a plane of said pocket device.

17. The pocket device of claim 1 wherein said pocket device has a height dimension extending perpendicular to said edge of said first pocket panel, said pocket device having a lower edge positioned at a lower extent of said height dimension of said pocket device, and wherein said first and second reinforcing materials are each positioned a same distance from said lower edge along said height dimension.

18. The pocket device of claim 1 wherein said first reinforcing material extends around an entire perimeter of said at least one biding hole of said first pocket panel and said second reinforcing material extends around an entire perimeter of said at least one binding hole of said second pocket panel.

19. The pocket device of claim 1 wherein said edge of said first reinforcing material is coincident with an entire perimeter of said edge of said at least one binding hole of said first pocket panel and said edge of said second reinforcing material is coincident with an entire perimeter of said edge of said at least one binding hole of said second pocket panel.

20. A pocket device comprising:

a first major panel and a second major panel coupled together along a major fold line and configured such that the first and second major panels are generally parallel but not co-planar and overlap in a thickness direction of the pocket device;

a first pocket panel coupled to said first major panel and defining a first pocket with said first major panel, said first pocket panel having an edge positioned adjacent to a mouth of said first pocket;

a second pocket panel coupled to said second major panel and defining a second pocket with said second major panel, said second pocket panel having an edge positioned adjacent to a mouth of said second pocket;

a first reinforcing material positioned on said first pocket panel adjacent to said mouth of the first pocket; and a second reinforcing material positioned on said second pocket panel adjacent to said mouth of the second pocket, wherein said first reinforcing material is made of a different material than a material of said first pocket panel, and wherein said second reinforcing material is made of a different material than a material of said second pocket panel, and wherein said first and second reinforcing materials are integrally formed together and both together made of a single, unitary piece of material.

21. The pocket device of claim 20 wherein the first reinforcing material is spaced apart from the edge of the first pocket panel and the second reinforcing material is spaced apart from the edge of the second pocket panel.

22. The pocket device of claim 20 wherein the first reinforcing material abuts against the edge of the first pocket panel with no gap therebetween and the second reinforcing material abuts against the edge of the second pocket panel with no gap therebetween.

23. The pocket device of claim 20 wherein the first and second pockets are generally parallel and aligned but not co-planar.

24. The pocket device of claim 20 wherein said first major panel, said second major panel, said first pocket panel and said second pocket panel each include binding holes extending therethrough, and wherein the pocket device further includes a binding device extending through each of said binding holes, and wherein said first reinforcing material has an edge coincident with at least part of an edge of at least one binding hole of said first pocket panel, and wherein said second reinforcing material has an edge coincident with at least part of an edge of at least one binding hole of said second pocket panel.

25. The pocket device of claim 20 wherein said first and second reinforcing materials each constitute an outermost surface of said pocket device in a thickness direction thereof.

26. The pocket device of claim 20 wherein said first pocket panel and said second pocket panel are coupled together along a pocket panel fold line, and wherein said single, unitary piece of material extends over and is in direct contact with said pocket panel fold line.

27. The pocket device of claim 20 wherein said pocket device is generally rectangular in top view and has four outer edges, and wherein the first reinforcing material extends from one of said outer edges to an opposite outer edge which is parallel thereto.

28. The pocket device of claim 24 wherein said first reinforcing material extends around an entire perimeter of said at least one binding hole of said first pocket panel and said second reinforcing material extends around an entire perimeter of said at least one binding hole of said second pocket panel.

29. The pocket device of claim 24 wherein said binding device is a coil binding mechanism or a spiral binding mechanism or a twin-wire binding mechanism.

30. A bound device comprising:

a binding device; and a pocket device bound to the binding device, the pocket device including:

a first major panel and a second major panel coupled together along a major fold line and configured such that the first and second major panels are generally parallel and overlap in a thickness direction of the pocket device;

a first pocket panel coupled to said first major panel and defining a first pocket with said first major panel, said first pocket panel having an edge defining a mouth of said first pocket;

a second pocket panel coupled to said second major panel and defining a second pocket with said second major panel, said second pocket panel having an edge defining a mouth of said second pocket;

a first reinforcing material positioned on said first pocket panel adjacent to said mouth of the first pocket, wherein the first reinforcing material has an outer edge that is coincident with the edge of the first pocket panel; and a second reinforcing material positioned on said second pocket panel adjacent to said mouth of the second pocket, wherein the second reinforcing material has an outer edge that is coincident with the edge of the second pocket panel, wherein the first and second reinforcing materials are each made of a different material than a material of said first major panel, second major panel, first pocket panel or second pocket panel.

31. The bound device of claim 30 wherein the first reinforcing material abuts against the edge of the first pocket panel with no gap therebetween and the second reinforcing material abuts against the edge of the second pocket panel with no gap therebetween.

32. The bound device of claim 30 wherein the first and second reinforcing materials each include a hole formed therethrough and wherein binding device extends through the holes of the first reinforcing material and the second reinforcing material.

33. The bound device of claim 30 wherein said first major panel, said second major panel, said first pocket panel and said second pocket panel each include binding holes extending therethrough, and wherein said binding device extends through each of said binding holes, and wherein said first reinforcing material is positioned at at least part of an edge of at least one binding hole of said first pocket panel, and wherein said second reinforcing material is positioned at at least part of an edge of at least one binding hole of said second pocket panel.

34. The bound device of claim 30 wherein said first major panel, said second major panel, said first pocket panel and said second pocket panel each include ring binding holes extending therethrough, said ring binding holes being spaced and configured to receive a three ring binder therethrough, and wherein said first reinforcing material and said second reinforcing material are both entirely spaced away from said ring binding holes.

35. The bound device of claim 30 wherein each reinforcing material extends along an entire width of the pocket device in a direction parallel to the length of the reinforcing material.

36. The bound device of claim 30 wherein each mouth and each edge extend an entire width of the bound device from one outer edge of the associated major panel to another, opposite outer edge of the associated major panel.

37. The bound device of claim 30 wherein the first major panel, second major panel, first pocket panel and second pocket panel are made of a single, unitary, one-piece sheet of material.

38. The bound device of claim 30 wherein the first and second reinforcing materials are each a polymer tape.

39. The bound device of claim 30 wherein the first and second major panels are generally parallel but not co-planar such that the first and second pockets are positioned on opposite sides of the pocket device.

40. The bound device of claim 30 wherein said first reinforcing material and said second reinforcing material each extend across an entire width of the pocket device in a direction parallel to the reinforcing materials.

41. The bound device of claim 30 wherein the first and second pocket panels each have a height dimension extending generally perpendicular to the associated edge, and wherein each pocket panel has a height less than a height of an associated major panel.

42. The pocket device of claim 30 wherein said first and second reinforcing materials each constitute an outermost surface of said pocket device in a thickness direction thereof.

43. The bound device of claim 30 further comprising a front cover and a back cover bound to said pocket device, wherein said pocket device is positionable between said front cover and said back cover such that said first and second reinforcing materials are not manually accessible.

44. The bound device of claim 33 wherein said first reinforcing material extends around the an entire perimeter of said at least one binding hole of said first pocket panel and said second reinforcing material extends around an entire perimeter of said at least one binding hole of said second pocket panel.

45. The bound device of claim 44 wherein said binding device is a coil binding mechanism or a spiral binding mechanism or a twin-wire binding mechanism, and wherein said bound device further includes a plurality of papers bound to the binding device.

46. The pocket device of claim 12 wherein said first reinforcing material is spaced apart from said edge of said first pocket panel along an entire length of said edge of said first pocket panel and wherein said second reinforcing material is spaced apart from said edge of said second pocket panel along an entire length of said edge of said second pocket panel.

47. The pocket device of claim 26 wherein said pocket device is folded about said pocket panel fold line such that said pocket panel fold line is an outer-most edge of said pocket device.

48. The pocket device of claim 27 wherein said first reinforcing material intersects said one of said outer edges and said opposite outer edge.

* * * * *